US012747870B2

(12) United States Patent
Schechner et al.

(10) Patent No.: US 12,747,870 B2
(45) **Date of Patent: *Sep. 29, 2026**

(54) CIRCULATING AIR MODULE AND CIRCULATING AIR MODULE SYSTEM

(71) Applicant: Envola GmbH, Ulm (DE)

(72) Inventors: Alexander Schechner, Ulm (DE); Gerhard Ihle, Ulm (DE); Felix Klaiber, Rammingen (DE); Nicola Franzoi, Plochingen (DE)

(73) Assignee: Envola GmbH, Ulm (DE)

( * ) Notice: Subject to any disclaimer, the term of this patent is extended or adjusted under 35 U.S.C. 154(b) by 98 days.

This patent is subject to a terminal disclaimer.

(21) Appl. No.: 18/709,568

(22) PCT Filed: Nov. 18, 2022

(86) PCT No.: PCT/EP2022/082492

§ 371 (c)(1),
(2) Date: May 13, 2024

(87) PCT Pub. No.: WO2023/089137

PCT Pub. Date: May 25, 2023

(65) Prior Publication Data

US 2025/0003605 A1 Jan. 2, 2025

(30) Foreign Application Priority Data

Nov. 19, 2021 (DE) ..... 10 2021 130 300.1
Apr. 22, 2022 (DE) ..... 10 2022 109 804.4

(51) Int. Cl.
*F24F 1/0035* (2019.01)
*F24F 1/0022* (2019.01)
(Continued)

(52) U.S. Cl.
CPC ..... *F24F 1/0035* (2019.02); *F24F 1/0022* (2013.01); *F24F 1/0033* (2013.01);
(Continued)

(58) Field of Classification Search
CPC ..... F24F 1/0035; F24F 1/0057; F24F 1/0063; F24F 1/0022; F24F 1/0033; F24F 7/013; F24F 7/08
(Continued)

(56) References Cited

U.S. PATENT DOCUMENTS 2,275,295 A * 3/1942 Greenway ..... F24F 1/0047 62/317
3,097,287 A * 7/1963 Knoll ..... F24H 3/0411 165/53
(Continued)

FOREIGN PATENT DOCUMENTS

CN 107218657 A 9/2017
CN 110470031 A 11/2019
(Continued)

OTHER PUBLICATIONS

International Search Report in PCT/EP2022/082491, mailed Feb. 16, 2023.
(Continued)

*Primary Examiner* — Terrell L Mckinnon
(74) *Attorney, Agent, or Firm* — Collard & Roe, P.C.

(57) ABSTRACT

A circulating air module with fresh air intake which can be introduced into or secured to an interior space building wall, or into a ceiling region or a ceiling of the space, includes a housing with front and opposing rear sides, a fresh air inlet for fresh air to flow into the housing, and inside air inlet and outlet openings; a heat exchanger; an inside air radial fan having an axially arranged air inlet, facing the exchanger, for drawing through the exchanger inside air flowing in through
(Continued)

the inside air inlet opening as circulating air. The exchanger is between the front or rear side and the fan, wherein the air inlet thereof faces this side. Fresh air is supplied to the circulating air in the housing and the circulating air flows out of the inside air outlet opening as supply air along with the added fresh air.

15 Claims, 19 Drawing Sheets

(51) Int. Cl.

| | |
|---|---|
| ***F24F 1/0033*** | (2019.01) |
| ***F24F 1/0057*** | (2019.01) |
| ***F24F 1/0063*** | (2019.01) |
| ***F24F 7/013*** | (2006.01) |
| ***F24F 7/08*** | (2006.01) |
| ***F24F 12/00*** | (2006.01) |
| *F24F 7/00* | (2021.01) |

(52) U.S. Cl.
CPC ..... *F24F 1/0057* (2019.02); *F24F 1/0063* (2019.02); *F24F 7/013* (2013.01); *F24F 7/08* (2013.01); *F24F 12/003* (2013.01); *F24F 2007/001* (2013.01); *F24F 2221/14* (2013.01); *F24F 2221/20* (2013.01)

(58) Field of Classification Search
USPC ..... 248/53; 454/233, 236, 228; 165/53
See application file for complete search history.

(56) References Cited

U.S. PATENT DOCUMENTS

| | | | | |
|---|---|---|---|---|
| 3,831,395 | A | 8/1974 | Levy | |
| 6,241,600 | B1 * | 6/2001 | Uehara | F24F 7/013 454/235 |
| 6,358,139 | B1 | 3/2002 | Renz | |
| 6,551,185 | B1 * | 4/2003 | Miyake | F24F 7/10 454/233 |
| 8,844,608 | B2 * | 9/2014 | Kimura | F24F 1/00075 165/53 |
| 2004/0244403 | A1 * | 12/2004 | Kim | F24F 1/0022 62/419 |
| 2007/0113527 | A1 * | 5/2007 | Song | F24F 8/108 55/385.2 |
| 2010/0263829 | A1 * | 10/2010 | Kimura | F24F 1/00075 165/104.34 |
| 2013/0281001 | A1 * | 10/2013 | Yamaguchi | F24F 12/006 454/252 |
| 2019/0178506 | A1 | 6/2019 | Freiherr et al. | |
| 2021/0025602 | A1 * | 1/2021 | Fuse | F24F 13/065 |
| 2023/0266037 | A1 | 8/2023 | Schechner et al. | |
| 2025/0003605 | A1 * | 1/2025 | Schechner | F24F 1/0057 |
| 2025/0012458 | A1 * | 1/2025 | Schechner | F24F 1/0022 |
| 2025/0027665 | A1 * | 1/2025 | Schechner | F24F 1/0022 |

FOREIGN PATENT DOCUMENTS

| | | | | |
|---|---|---|---|---|
| CN | 213019969 | U | 4/2021 | |
| DE | 299 16 321 | U1 | 12/1999 | |
| DE | 200 08 641 | U1 | 8/2000 | |
| DE | 203 13 693 | U1 | 12/2003 | |
| DE | 202 16 099 | U1 | 3/2004 | |
| DE | 10 2010 016 077 | A1 | 10/2010 | |
| DE | 11 2011 101 405 | T5 | 4/2013 | |
| DE | 10 2016 111 136 | A1 | 12/2017 | |
| DE | 10 2020 119 653 | B3 | 7/2021 | |
| EP | 1 484 558 | A1 | 12/2004 | |
| EP | 1 411 303 | B1 | 7/2005 | |
| EP | 2 620 715 | A1 | 7/2013 | |
| JP | H10-131391 | A | 5/1998 | |
| JP | 10253108 | A * | 9/1998 | F24F 7/013 |
| JP | 2005274098 | A * | 10/2005 | F24F 12/006 |
| JP | 2006002969 | A * | 1/2006 | F24F 7/10 |
| WO | 2011/132998 | A2 | 10/2011 | |

OTHER PUBLICATIONS

International Search Report in PCT/EP2022/082492, mailed Feb. 6, 2023.
International Search Report in PCT/EP2022/082493, mailed Feb. 16, 2023.

* cited by examiner

CIRCULATING AIR MODULE AND CIRCULATING AIR MODULE SYSTEM

CROSS REFERENCE TO RELATED APPLICATIONS

This application is the National Stage of PCT/EP2022/082492 filed on Nov. 18, 2022, which claims priority under 35 U.S.C. § 119 of German Application No. 10 2021 130 300.1 filed on Nov. 19, 2021 and German Application No. 10 2022 109 804.4 filed Apr. 22, 2022, the disclosures of which are incorporated by reference. The international application under PCT article 21(2) was not published in English.

The invention relates to a circulating air module with fresh air intake, which not only circulates the inside air in an interior space of a building, but can also add fresh air to it. Furthermore, the invention relates to a circulating air module system comprising such a circulating air module and a mounting frame.

In closed buildings and interior spaces with a climate control system for heating and cooling the inside air, fresh air supply nevertheless contributes to increasing the comfort level.

U.S. Pat. No. 3,831,395 A shows a cabinet-sized air conditioning system in which inside air flows through the cabinet as circulated air along a first path. The circulating air flows through a cooling coil or an evaporator, behind which there is arranged an air movement device, which can be a fan. Fresh air can flow into the air conditioning system through a wall opening and can mix with the circulated air.

DE 11 2011 101 405 T5 shows a ventilation arrangement for a window arranged on the frame with a heat exchanger module to enable heat exchange between air introduced from an outside space and air introduced from an interior space without any mixing in between.

DE 10 2010 016 077 A1 describes an air conditioning device for air conditioning a room with a floor and a cavity underneath. A fan is arranged in the cavity or in the lower region of the air conditioning unit so that air flows through the air conditioning unit via the cavity through the floor into the room. In mixed mode, fresh air and inside air can flow through the air conditioning unit.

DE 203 13 693 U1 describes an air conditioning unit with a supply air module with an evaporator and a fresh air fan, an exhaust air module with a condenser and a second fan as well as connections for exhaust air, supply air, outgoing air and outside air. The supply air module and the exhaust air module are arranged one above the other.

The object is to provide a circulating air module for temperature control of the inside air with the addition of fresh air.

The problem is solved by a circulating air module with fresh air intake and a circulating air module system having the features of the additional independent claims.

The circulating air module with fresh air intake can be introduced into a building wall of an interior space or secured to the building wall of the interior space or introduced into a ceiling region or secured to a ceiling of an interior space. The circulating air module comprises a housing with a front side and an opposite rear side, as well as a fresh air inlet, an inside air inlet opening and an inside air outlet opening. The fresh air inlet is designed so that fresh air can flow into the housing. The circulating air module also comprises a heat exchanger arranged in the housing, an inside air radial fan arranged in the housing and having an axially arranged air inlet, facing the heat exchanger, such that inside air flowing in through the inside air inlet opening as circulating air can be drawn through the heat exchanger. The heat exchanger is located between one of the front and rear side and the inside air radial fan, the air inlet of which is facing said side. The circulating air module is designed such that the fresh air is supplied to the circulating air in the housing and the circulating air flows out of the inside air outlet opening as supply air along with the added fresh air.

Circulating air is the inside air flowing into the circulating air module. Supply air flows from the circulating air module into the interior space and is the temperature-controlled circulating air with added fresh air. The circulating air module is designed to circulate the inside air in at least one interior space of the building and to control the temperature in the process. Fresh air is added to improve the indoor climate. Advantageously, the circulating air module is designed so that the fresh air can be drawn through the heat exchanger and mixes with the circulating air in the housing. The addition of fresh air increases the level of comfort for people breathing in and out and therefore breathing air.

In one embodiment, the circulating air module is permanently mounted on the building wall or at least partially recessed into the building wall so that the rear side of the housing faces away from the interior space. The front side faces the interior space. In the building's temperature-controlling climate system, the circulating air module contributes to temperature regulation and fresh air supply. Although it is usually designed as a separate device, it can be regarded as a module of the decentralized air conditioning system, as part of which it can also be controlled. Alternatively or additionally, stand-alone operation is possible.

The circulating air module can be mounted on the building wall inside the building or, advantageously, can be at least partially recessed into the building wall so that it has access both to the inside air flowing through the circulating air module and to fresh air. The building wall on which the circulating air module is mounted is advantageously a building wall separating the interior from the exterior. Fresh air can be accessed through a recess in the building wall, for example. It can be installed in a recess in the building wall, for example at the top of a window or door opening, allowing easy access to fresh air. Advantageously, installation takes place in a roller shutter box, which is a box-like component for holding a rolled-up roller shutter. It is installed on the side of the roller shutter box facing the interior space so that the function of the roller shutter box and its roller shutter is not impaired. Overall, the circulating air module is a very compact device that can have a rectangular, in particular flat, rectangular housing so that it can be installed in the building in the manner described above.

Designs that can be mounted on the building wall advantageously have, located in the housing, a fresh air supply fan which is arranged between the front side and rear side of the housing to the side of the inside air radial fan. The expression "to the side" means that the fans are arranged in a plane that does not run vertically between the front side and rear side, but in particular parallel to the front side and rear side.

In one embodiment, the circulating air module is arranged on an interior space ceiling, for example in a ceiling region above a suspended ceiling. Alternatively, the circulating air module can be attached to the ceiling so that it protrudes into the interior space. Fresh air can be accessed, for example, through a recess in the outer wall of the building in the ceiling region. The fresh air supply can be supported by an externally arranged fresh air fan on the circulating air module. Alternatively, a fresh air duct is provided, through which fresh air is fed from outside to the circulating air module.

The housing encloses the at least one inside air radial fan and the heat exchanger. The inside air inlet opening and the inside air outlet opening are recesses in the housing through which inside air flows into the housing as circulating air or flows out of the housing as supply air after the temperature control and fresh air intake of the inside air flowing in as circulating air has taken place. The housing has a front side and an opposite rear side, two opposite longitudinal sides and two opposite transverse sides. A longitudinal direction runs between the transverse sides, preferably parallel to the longitudinal sides. A depth direction runs transversely between the front side and rear side.

The inside air radial fan has an axial air inlet and a radial air outlet so that the circulating air that has been drawn through the heat exchanger enters the inside air radial fan in an axial direction and is discharged radially before it flows onto the inside air outlet opening. Advantageously, an inside air flow deflector is provided, which runs around the inside air radial fan and is designed to direct air flowing out of the inside air radial fan to the inside air outlet opening. Such an inside air flow deflector can be designed as a spiral housing.

The heat exchanger is designed as an air/heat exchanger to transfer thermal energy from air flowing through it to a fluid flow passing through it, or vice versa. The fluid flow passes through the pipes of the heat exchanger, past which the inside air flows on the outside, resulting in energy transfer. In summer, the aim is to cool the inside air by dissipating the thermal energy of the circulating air through the fluid flow in the heat exchanger so that the circulating air cools down. To heat the inside air, thermal energy is transferred from the fluid flow to the circulating air flowing past. After flowing through the heat exchanger, the temperature-controlled circulating air is discharged through the inside air radial fan and flows out of the housing through the inside air outlet opening. Advantageously, the heat exchanger comprises fins that direct the air so that it flows vertically through the heat exchanger, i.e., from one of the longitudinal sides to the other longitudinal side. In one exemplary embodiment, the fins are transverse fins, the main fin surface of which is arranged perpendicular to the longitudinal direction so that the air can escape in the depth direction. However, this is prevented by the front side of the housing. However, the air flowing vertically through the heat exchanger can be drawn out of the heat exchanger laterally in a depth direction through the air inlets of the inside air radial fans at the rear side of the heat exchanger.

The fresh air inlet and the optional fresh air supply fan located at the fresh air inlet are intended for supplying and adding fresh air into the temperature-controlled circulating air.

The fresh air fan is designed to draw fresh air into the housing through the fresh air inlet, said fresh air then being added to the temperature-controlled circulating air. The fresh air fan is also advantageously designed as a radial fan. The fresh air fan is arranged on the outside of the housing in one embodiment. Alternatively, it is advantageously arranged to the side of the inside air radial fan so that they are offset from each other along a longitudinal direction. Advantageously, they are aligned in a row on a line parallel to the longitudinal direction. Their inlets point in opposite directions, advantageously parallel or antiparallel to the depth direction. Advantageously, a fresh air flow deflector is also provided, which runs around the fresh air fan and is designed to direct fresh air flowing out of the fresh air fan into a flow channel that guides it to the heat exchanger. Such a fresh air flow deflector can have a wall running spirally around the fresh air fan between the front and rear sides. One open side of the wall leads into the flow channel and directs the fresh air into it.

The heat exchanger is located between one of the front and rear side and the inside air radial fan, the air inlet of which is facing said side. The inside air radial fan is located between the heat exchanger and the other side of the front and rear. Advantageously, the heat exchanger is located at the front side and the inside air radial fan at the rear side. The reverse arrangement is also possible.

Advantageously, the inside air inlet opening and the inside air outlet opening are arranged on the same longitudinal side or opposite longitudinal sides of the housing. In one embodiment, the inside air inlet opening is arranged adjacently to the front side to which the heat exchanger is adjacent, and the inside air outlet opening is arranged adjacent to the rear side to which the inside air radial fan(s) are adjacent. In one embodiment, the fresh air inlet comprises one or more openings in the housing, which are arranged at the front or rear side. In an embodiment with a fresh air fan arranged in the housing, the fresh air inlet is preferably at the rear side. In an embodiment that can be ceiling-mounted, the fresh air inlet is arranged adjacently to the longitudinal side opposite the inside air inlet opening and the inside air outlet opening, wherein the fresh air inlet is preferably arranged on the side adjacent to the heat exchanger.

The front and rear sides of the housing direct the inside air flow into the heat exchanger and, after flowing through the inside air radial fan, in the direction of the inside air outlet opening. If the heat exchanger is arranged at the front side and the inside air radial fan at the rear side, the inside air inlet opening is arranged in the longitudinal side adjacent to the front side and the inside air outlet opening, advantageously in the same longitudinal side, adjacently to the rear side. The inside air flows into the housing from below as circulating air, from front to back and then downwards out of the housing as supply air.

In one embodiment, the inside air radial fan is one of a plurality of inside air radial fans that are arranged laterally next to one another between the front side and the rear side of the housing, so that the axially arranged air inlets of the inside air radial fans face the heat exchanger. The fresh air fan is arranged as an external fan adjacent to one of the transverse sides. By providing several indoor air radial fans, which are arranged in particular in a longitudinal direction of the heat exchanger, an elongated circulating air module can be provided for installation in a roller shutter box with good performance. A plane runs through the inside air radial fans so that the axially arranged air inlets point away from the same side of the plane. Apart from dimensional and manufacturing tolerances, the axial axes of rotation of the inside air radial fans run perpendicular or almost perpendicular to the plane and/or advantageously, apart from dimensional and manufacturing tolerances, parallel or almost parallel to each other. Although the inside air radial fans can be arranged axially offset in the plane, their air inlets are advantageously aligned so that they lie in one plane or almost in one plane and, apart from dimensional and manufacturing tolerances, there is no axial offset of the inside air radial fans.

In one embodiment, an inside air flow deflector runs around the inside air radial fan(s) and is designed to direct air flowing out of the inside air radial fan to the inside air outlet opening. Advantageously, the inside air radial fan or fans are of modular design so that a fan module with an inside air radial fan can be easily removed individually from the circulating air module and replaced if necessary. If a fresh air fan is provided in the housing, this can be of modular design.

Advantageously, the circulating air module comprises a flow channel that is designed to guide the supplied fresh air to the heat exchanger, through which the fresh air can be drawn with the inside air radial fan(s). In one embodiment, the flow channel runs between the heat exchanger and a longitudinal side of the housing and is open on the side facing the heat exchanger or has several openings. This longitudinal side is advantageously opposite the longitudinal side in which the inside air inlet opening and the inside air outlet opening are located. The flow channel is designed as a flow barrier to the inside air radial fans, so that the air from the flow channel cannot flow directly to the inside air outlet opening or to the inside air radial fans, but must first flow through the heat exchanger. The fresh air flows vertically from one of the longitudinal sides, for example from top to bottom, through the heat exchanger and the inside air flows vertically from the opposite longitudinal side, for example from bottom to top, through the heat exchanger. Due to the suction effect of the inside air radial fan(s), a large proportion of the fresh air and inside air flows vertically onto the inlets of the inside air radial fans and is mixed when it meets in the radial inside fans. The fresh air discharged by the inside air radial fan(s) mixes with the circulating air that the inside air radial fan(s) have simultaneously drawn through the heat exchanger. However, air mixing also occurs upstream and downstream of the radial inside fans due to turbulence and deflection. Fresh air and circulating air flowing into the heat exchanger from opposite sides are also mixed in the heat exchanger.

A circulating air module system comprises the circulating air module described above and a mounting frame which can be integrated into the building wall and into which the circulating air module can be inserted and fastened so that the circulating air module can be recessed into a building wall. Such a mounting frame can be a drywall frame and can be integrated into a building wall of a prefabricated house, for example.

Advantageously, the mounting frame can be installed in a roller shutter box so that the rear side of the circulating air module inserted in the mounting frame faces the inside of the roller shutter box. Installation in the shutter box is accompanied by advantageous placement of the circulating air module above the window and enables easy access to fresh air through the shutter box. In one embodiment, the mounting frame can be installed in the roller shutter box so that the inside air inlet opening and the inside air outlet opening are on a lower longitudinal side of the housing, which at least partially forms an upper side of a window opening on the interior-space side. Apart from the inside air inlet opening and the inside air outlet opening on a lower longitudinal side, this circulating air module can disappear completely under a wall cladding, such as plasterboard or plaster.

In one embodiment, a circulating air module system is provided with a circulating air module and a mounting frame that can be installed in a ceiling region or attached to a ceiling. Advantageously, the mounting frame can be mounted on a suspended ceiling so that the inside air inlet opening and the inside air outlet opening of the circulating air module face the inside of the room. In one embodiment, the mounting frame or the fresh air inlet can be coupled with a fresh air duct, via which fresh air can be fed to the circulating air module. This enables a reliable supply of fresh air even with ceiling-mounted circulating air modules.

Some exemplary embodiments are explained in greater detail below with reference to the drawing. In the drawings:

FIG. 1 shows a schematic front view of a building wall of an interior space, FIG. 2 shows a schematic sectional view of an exemplary embodiment of a circulating air module in a roller shutter box, FIG. 3 shows a three-dimensional rear view of an exemplary embodiment of a circulating air module with a mounting frame, FIG. 4 shows a three-dimensional front view of an exemplary embodiment of a circulating air module with the mounting frame, FIG. 5 shows a schematic front view of an exemplary embodiment of a circulating air module in which the front housing wall has been removed, FIG. 6 shows a schematic rear view of an exemplary embodiment of a circulating air module in which the rear housing wall has been removed, FIG. 7 shows a side sectional view of the circulating air module, FIG. 8 shows a schematic side sectional view of a fresh air inlet, a filter and a fresh air fan, FIG. 9 shows a schematic front view of a fresh air fan in the housing, FIG. 10 shows a three-dimensional rear view of another exemplary embodiment of a circulating air module, FIG. 11 shows a longitudinal sectional view of the circulating air module, FIG. 12 shows another longitudinal sectional view of the circulating air module, FIG. 13 shows a side sectional view of the circulating air module, FIG. 14 shows flows through the circulating air module on the basis of a longitudinal sectional view, FIG. 15 shows an exemplary embodiment of a circulating air module system, FIG. 16 shows a top view of a mounting frame into which a circulating air module has been inserted, FIG. 17 shows another top view of the mounting frame into which the circulating air module has been inserted, FIG. 18 shows a three-dimensional detailed view of the circulating air module system, FIG. 19 shows a three-dimensional representation of the circulating air module system, FIG. 20 shows the interior of the circulating air module system, FIG. 21 shows a further illustration of the interior of the circulating air module system, FIG. 22 shows a side sectional view through the circulating air module system, FIG. 23 shows another exemplary embodiment of a circulating air module, FIG. 24 shows schematically a ceiling-mounted exemplary embodiment of a circulating air module system, and FIG. 25 shows schematically an exemplary embodiment of a ventilation system.

In the drawings, the same or functionally equivalent components are provided with the same reference signs. Designations such as "front"/"rear", "top"/"bottom" or similar serve to simplify and illustrate the exemplary embodiments and do not necessarily denote absolute positions in space, but rather the relative positions of the features in relation to one another.

FIG. 1 shows a schematic front view of a building wall 1 of an interior space with a window 3, in which an exemplary embodiment of a circulating air module 5 is inserted.

The building wall 1 with the window 3 is an external wall of a building. Such a building wall 1 can be designed as a prefabricated wall of a prefabricated house. The circulating air module 5 is arranged above the window opening and extends across the entire width of the window in this exemplary embodiment. The circulating air module 5 is inserted into the building wall 1 so that it is recessed into it. One front side of the circulating air module 5 faces the interior space. The front side of the circulating air module 5 can be flush with the building wall 1 or, as in this exemplary embodiment, can be arranged under a wall cladding, such as plasterboard or plaster. In particular, the circulating air module 5 can be installed in a shutter box or a shutter box opening above the window opening. In alternative exemplary embodiments, the circulating air module 5 can partially protrude from the building wall 1 or can be mounted on it.

The circulating air module 5 is designed to heat, cool and supply fresh air to the inside air of the interior space. The circulating air module 1 can be mounted in or on the building wall 1 in such a way that an inside air inlet opening and an inside air outlet opening in the circulating air module 5 are arranged inside the building and the circulating air module 5 has fresh air access, for example through the shutter box. In this exemplary embodiment, a lower longitudinal side of the circulating air module 5, which at least partially forms an upper cover of the window opening, is accessible so that inside air can flow into the circulating air module 5 as circulating air and supply air, which is the temperature-controlled circulating air with fresh air intake, can flow out.

Advantageously, the circulating air module 5 can be inserted into a mounting frame, for example a drywall frame, which is integrated into the building wall 1. In the case of a building wall 1 designed as a prefabricated wall, such a mounting frame is advantageously already installed during its manufacture and integrated into the building wall 1 in order to provide space for the circulating air module 5 to be installed later. The mounting frame is advantageously integrated into the roller shutter box.

FIG. 2 shows a schematic sectional view of an exemplary embodiment in which the circulating air module 5 is mounted in a roller shutter box 7. The roller shutter box 7 is arranged above a window in the building wall 1, which separates the interior from the exterior. The circulating air module 5 is mounted above the window 3 on the side of the roller shutter box 7 facing the interior space, so that a rear side 17 of the circulating air module 5 faces the interior of the roller shutter box and an inside air inlet opening and an inside air outlet opening, which are arranged on a lower longitudinal side 21 of the circulating air module 5, are positioned in the interior space and the lower longitudinal side 21 at least partially forms an upper side of the window opening. A front side 15 of the circulating air module 5 is covered by a wall cladding 9, for example a plasterboard panel, to form a flat wall surface above the window 3.

FIG. 3 shows a three-dimensional rear view of an exemplary embodiment of a circulating air module 5 with a mounting frame 11.

The circulating air module 5 comprises a housing 13 with a front side 15, an opposite rear side 17, an upper longitudinal side 19 and an opposite lower longitudinal side 21 as well as two opposite transverse sides 23, 25. The basic shape of the housing 13 is an elongated cuboid and is dimensioned so that it can be installed in or attached to a roller shutter box 7. The housing 13 is flat so that it can be completely recessed into the building wall 1 and the front side 15 can be covered by a wall cladding 9.

A fresh air inlet 39 in the form of a recess is arranged in the rear side 17 of the housing 13 and can allow fresh air to flow into the housing 13. The recess is provided in a region of the rear side 17 that is adjacent to one of the transverse sides 23. A filter 41 is provided inside the housing in front of the recess in order to clean the incoming fresh air.

The mounting frame 11 is usually made of metal. It extends along the upper longitudinal side 19 and has, running parallel to and at a distance from the transverse sides 23, 25, metal tongues 27 to which it can be fastened in the building wall 1. Furthermore, the mounting frame 11 has struts 29 at the front and rear sides of the circulating air module 5 as well as an insertion opening through which the circulating air module 5 can be pushed into the mounting frame 11 from below.

An L-shaped profile 59 is provided on the front-side lower edge, which supports a wall cladding 9 that covers the circulating air module 5 inserted into the building wall 1.

The circulating air module 5 can be inserted from below into the mounting frame 11, which can be integrated into the building wall 1, in particular into the roller shutter box 7. During installation, the circulating air module 5 is pushed into the mounting frame 11 and locked so that it is then only accessible from below.

On the upper longitudinal side 19 of the housing 13 there are rotatable flat latches 31, the width of which is not greater than the width of the housing 13. When sliding into the mounting frame, the latches 31 are aligned in the longitudinal direction. After insertion, the circulating air module 5 is only accessible from below. The latches 31 are rotated so that they protrude at the front and/or rear over the longitudinal side 13 and engage in corresponding slots in the mounting frame 11. This approximately quarter turn is performed by a tool that engages in the housing 13 from below. The swung-out latches 31 hold and lock the circulating air module 5 in the mounting frame 11.

FIG. 4 shows a three-dimensional view of the exemplary embodiment of a circulating air module 5.

An inside air inlet opening 33 and an inside air outlet opening 35 are arranged on the lower longitudinal side 21, through which inside air flows into the housing 13 as circulating air and out of said housing as supply air. The inside air inlet opening 33 is elongated and arranged adjacent to the front side 15. The inside air outlet opening 35 is elongated and arranged adjacent to the rear side 17. To protect the components inside the housing and to influence the flow behavior, fins are provided at the inside air inlet opening 33 and at the inside air outlet opening 35, as well as a grille 37, which is magnetically fixed to allow easy access to the circulating air module 5 from below, in particular for locking and unlocking in the mounting frame 11 during installation or removal.

Inside air flows through the accessible lower longitudinal side 21 as circulating air into the circulating air module 5 and, after heating or cooling and the addition of fresh air, flows out of the circulating air module 5 as supply air.

FIG. 5 shows a schematic front view of the circulating air module 5 with the front housing wall removed.

A heat exchanger 43 is arranged inside the housing and runs along the front side 15. The heat exchanger 43 extends between the transverse sides 23, 25, but not up to them, so that the lateral edge regions adjacent to the transverse sides 23, 25 provide space for further components. A control unit 45 and a fresh air fan 47 are provided in these edge regions next to the heat exchanger 43. The heat exchanger 43 has a flat, cuboidal basic shape and has transverse fins, for example. Its underside is arranged above the inside air inlet opening 33, so that inside air flowing in as circulating air hits the heat exchanger 43.

Adjacent to a transverse side 25, the electronic control unit 45 for the circulating air module 5 is provided between the front and rear sides 15, 17 to the side of the heat exchanger 43. The control unit 45 controls the operation of the circulating air module 5, in particular heating and cooling of the inside air and the fresh air supply. The control unit 45 can exchange data with other components of an air conditioning system, of which the circulating air module 5 is only one part, and can be controlled either centrally or directly by a suitable (remote) control element. Further functional elements are provided in the control unit 45: a power supply for the components of the circulating air module 5, a computer/CPU as well as sensors for temperature and humidity and optionally a water connection for humidifying the circulating air.

Adjacent to the other transverse side 23, the fresh air fan 47 for drawing in and distributing fresh air and the filter 41 for cleaning the incoming fresh air are arranged between the front and rear sides 15, 17 and laterally next to the heat exchanger 43. The filter 41 is located between the fresh air inlet 39 and the fresh air fan 47.

FIG. 6 shows a schematic rear view of the circulating air module 5 with the rear housing wall and the filter 41 removed.

Inside the housing there are arranged a number of inside air radial fans 49, each with an axially arranged air inlet. In this exemplary embodiment, four inside air radial fans 49 are provided, which are arranged next to each other along the rear side 17 so that their air inlets face the heat exchanger 43. The inside air radial fans 49 are arranged side by side between the fresh air fan 47 and the control unit 45 in the longitudinal direction.

The fresh air fan 47 is also designed as a radial fan and is arranged laterally next to the row of inside air radial fans 49, so that it is positioned between these and the transverse side 23. Its axially arranged air inlet faces the fresh air inlet 39 in the rear side 17, so that it points in the opposite direction to the air inlets of the inside air radial fans 49.

FIG. 7 shows a side sectional view of the circulating air module 5. The cut runs through one of the inside air radial fans 49. The inside air inlet opening 33 is located below the heat exchanger 43 and the inside air outlet opening 35 is located below the inside air radial fan 49. The open regions above the inside air inlet opening 33 and the inside air outlet opening 35 are spatially separated. Above the heat exchanger 43, a flow channel 51 runs between the heat exchanger 43 and the upper longitudinal side 19 of the housing 13 in the longitudinal direction, which guides the fresh air 53 from the fresh air fan 47 to the upper side of the heat exchanger 43. The direct path from the flow channel 51 to the inside air radial fans 49 is blocked and only possible through the heat exchanger 43.

FIG. 8 shows a schematic side sectional view of the fresh air inlet 39, the filter 41 and the fresh air fan 47. Fresh air 53 is drawn in axially by the fresh air fan 47 through the fresh air inlet 39, which is designed as a recess. Before it reaches the fresh air fan 47, the fresh air 53 is cleaned by the filter 41. The fresh air fan 47 diverts the air flowing into the housing 13 radially so that it is directed into the flow channel 51. This is supported by the housing 13 being closed below the fresh air fan 47 and a spatial separation, for example a wall, being provided between the fresh air fan 47 and the inside air radial fans 49.

FIG. 9 schematically shows a front view of the fresh air fan 47. The fresh air fan 47 diverts the fresh air 53 flowing into the housing 13 radially so that it flows upwards along the transverse side 23 into the flow channel 51 running above the fresh air fan 47 and is directed from there to the heat exchanger 43.

FIGS. 6 and 7, as well as FIGS. 8 and 9, illustrate the operation of the circulating air module 5 using the arrows for fresh air 53, circulating air 55 and supply air 57. Inside air flowing into the circulating air module 5 is referred to as circulating air 55. Air flowing out of the circulating air module 5 into the interior space is referred to as supply air 57. During operation, the inside air radial fans 49 draw in the inside air as circulating air through the inside air inlet opening 33 and through the heat exchanger 43 and discharge it radially so that it flows out of the housing 13 as supply air 57 through the inside air outlet opening 35. When air flows through the heat exchanger 43, the interaction of the circulating air 55 with the heat exchanger 43 leads to a temperature change of the inside air. In cooling mode, the inside air is kept at a pleasantly cool temperature even in summer. In winter, heating is mainly used.

At the same time as the inside air is circulated and temperature-controlled, fresh air is added to the circulating air 55 by the fresh air fan 47. This draws fresh air 53 in an axial direction through the fresh air inlet 39 in the rear side 17 of the housing 13 and discharges it radially so that it is directed through the flow channel 51 to the upper side of the heat exchanger 43. The fresh air 53 is also drawn through the heat exchanger 43 by the inside air radial fans 49 and deflected radially, so that the fresh air 53 mixed with the circulating air 55 also flows out through the inside air outlet opening 17 as supply air 57. Due to the arrangement of the fresh air fan 47 at the edge, the fresh air 53 is primarily drawn through the heat exchanger 43 by the inside air radial fans 49 adjacent to the fresh air fan 47. This is illustrated by the arrows with the reference sign 53 in FIG. 6. Despite the uneven distribution, a mixture sufficient for a comfortable indoor climate is created, wherein the circulating air 55 and the fresh air 53 between the air outlets of the inside air radial fans 49 and the inside air outlet opening 35 are additionally mixed by the turbulence when leaving the inside air radial fans 49.

FIG. 10 shows a three-dimensional rear view of a further exemplary embodiment of a circulating air module 5 without mounting frame.

The circulating air module 5 comprises a housing 13 with a front side 15, an opposite rear side 17, an upper longitudinal side 19 and an opposite lower longitudinal side 21 as well as two opposite transverse sides 23, 25. The basic shape of the housing 13 is an elongated cuboid and is advantageously dimensioned so that it can be installed in or attached to a roller shutter box 7. The housing 13 is flat so that it can be completely recessed into the building wall 1 and the front side 15 can be covered by a wall cladding 9. Alternatively, the housing 13 can run flush with the building wall 1 and can be easily covered by wallpaper, for example.

A fresh air inlet 39 in the form of a rectangular recess is arranged in the rear side 17 of the housing 13 and can allow fresh air to flow into the housing 13. The recess is in a region of the rear side 17 that is adjacent to one of the transverse sides 23. A filter 41 is provided inside the housing in front of the recess in order to clean the incoming fresh air.

The housing 13 can be provided with a mounting frame 11, as described by way of example in conjunction with FIG. 3, but not shown in FIG. 10. On the upper longitudinal side 19 of the housing 13 there are rotatable flat latches 31, by means of which the housing 13 can be locked in the mounting frame 11, as has already been described in conjunction with FIG. 3.

Figure 1:
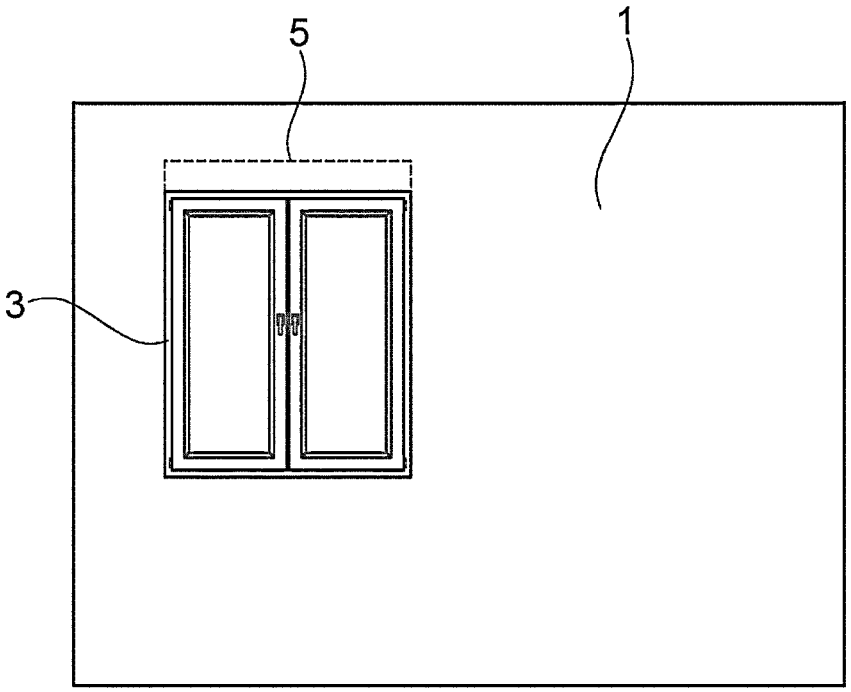
Figure 2:
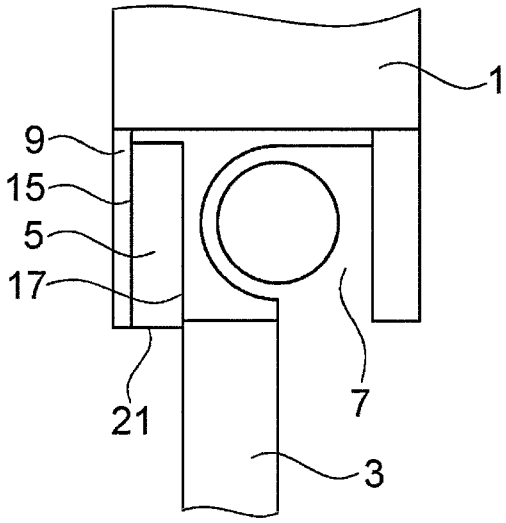
Figure 3:
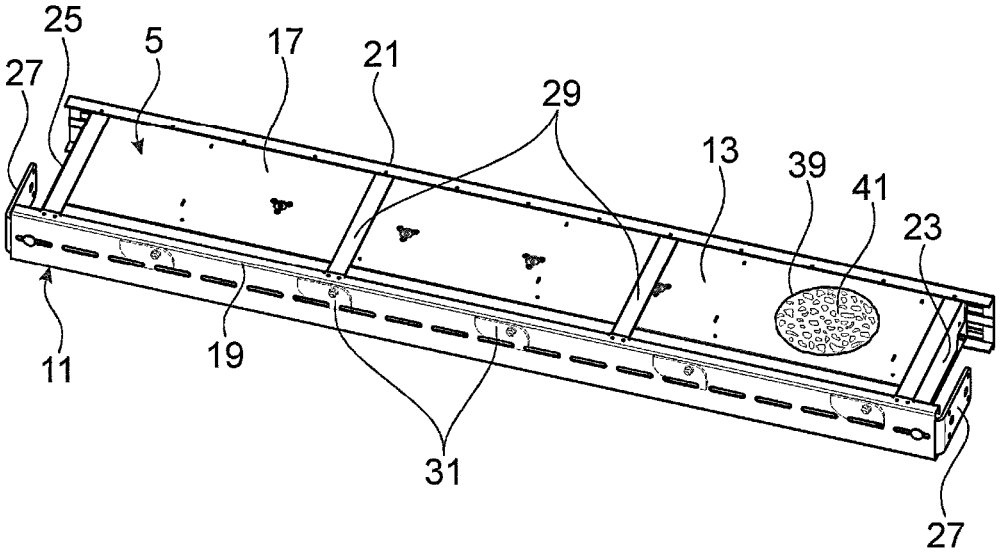
Figure 4:
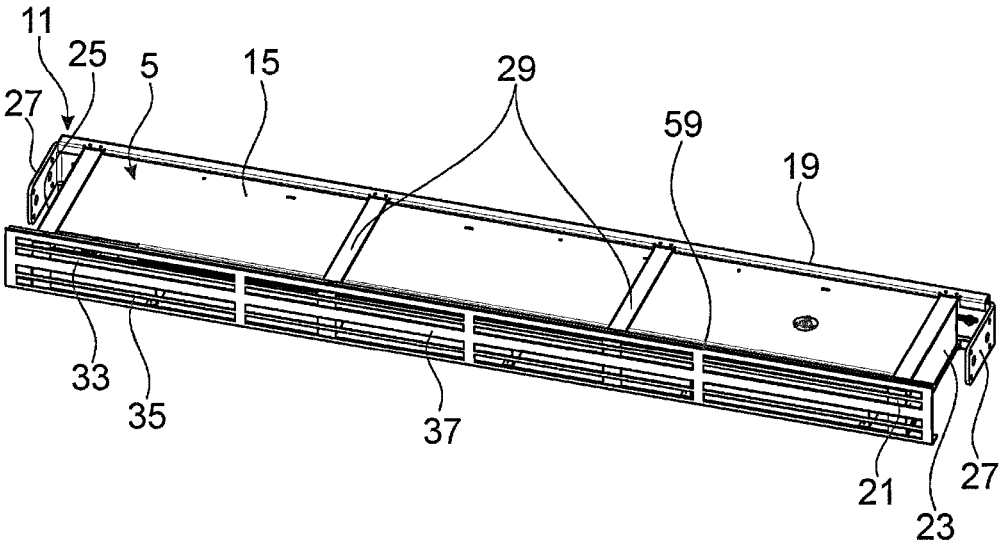
Figure 5:
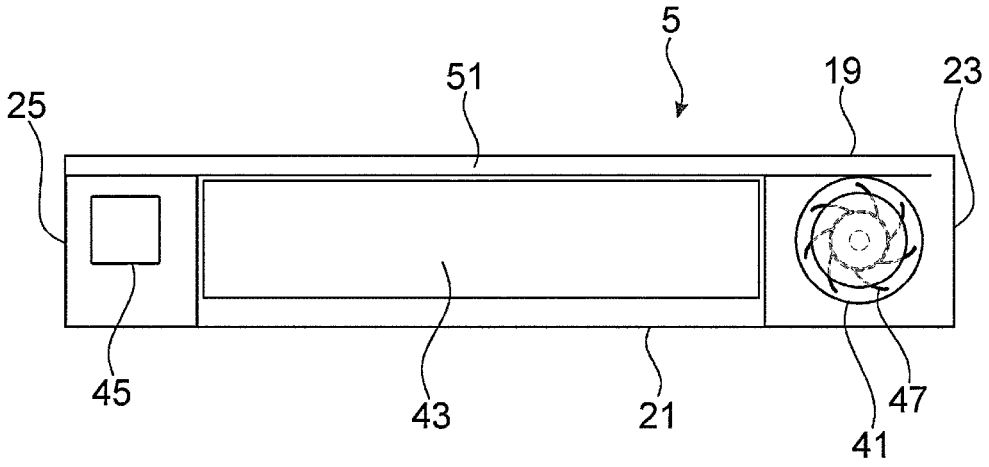
Figure 6:
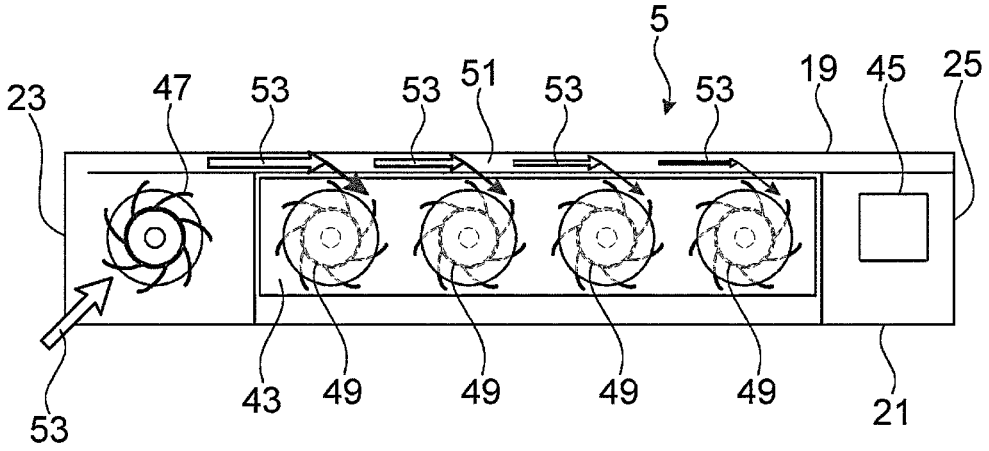
Figure 7:
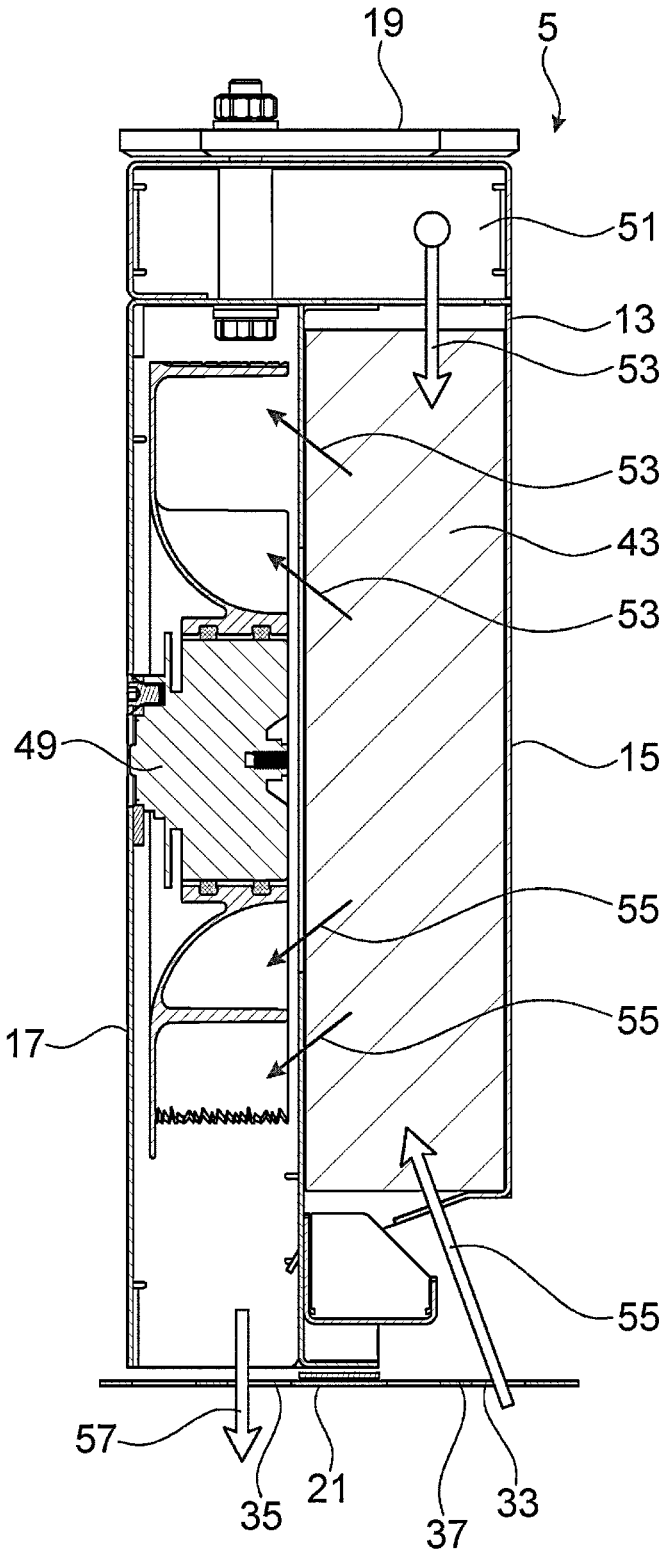
Figure 8:
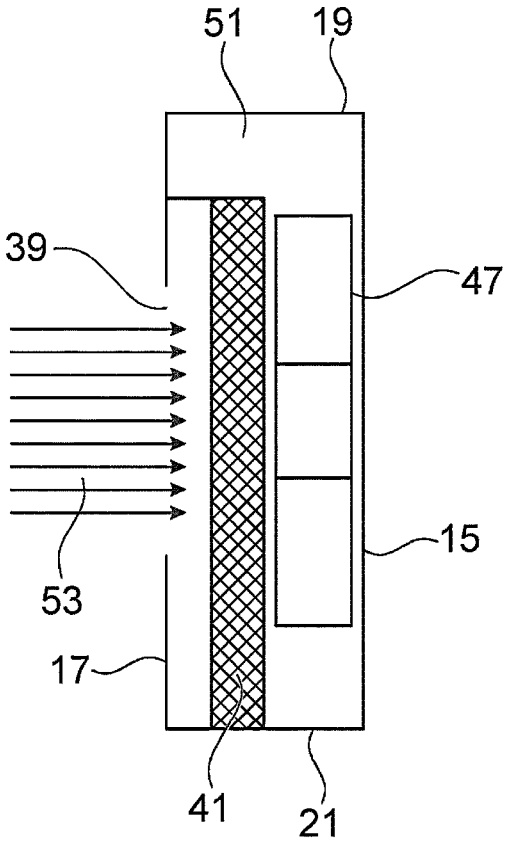
Figure 9:
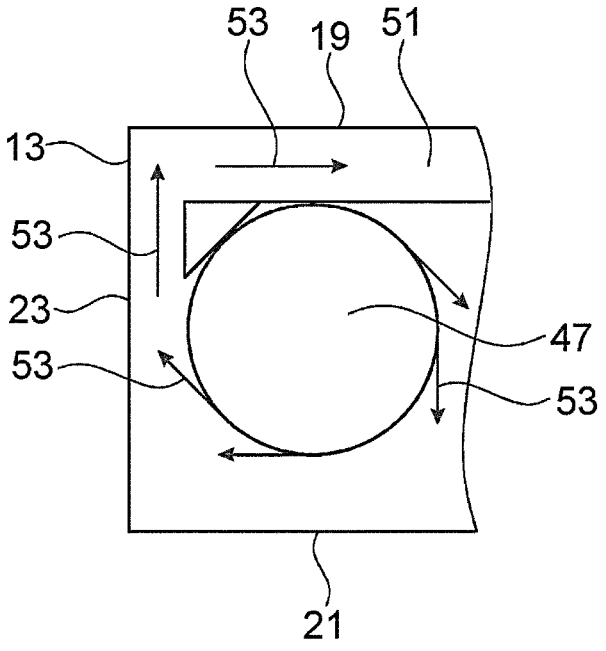
Figure 10:
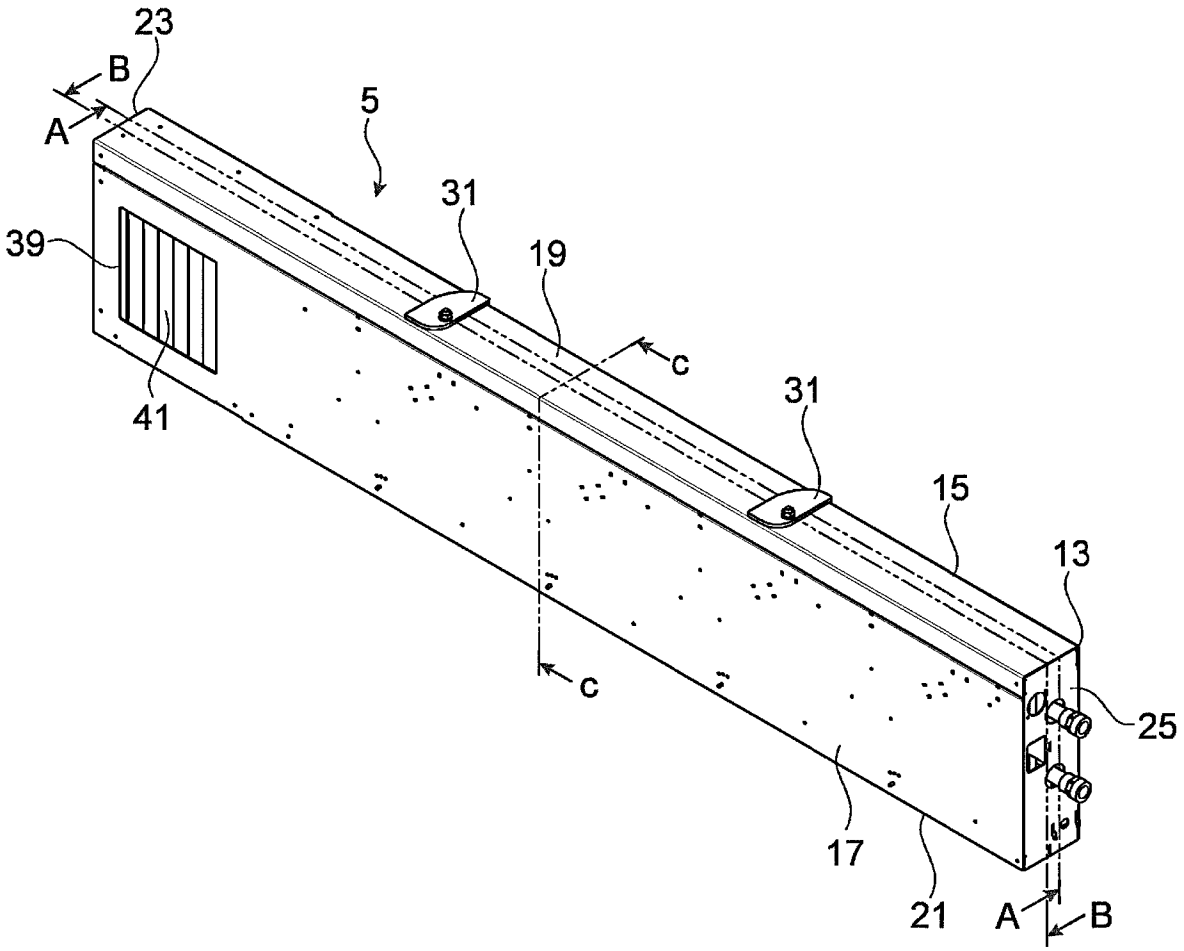
FIG. 10 shows three sectional planes A-A, B-B and C-C, the sectional views of which are shown in the following figures.
Figure 11:
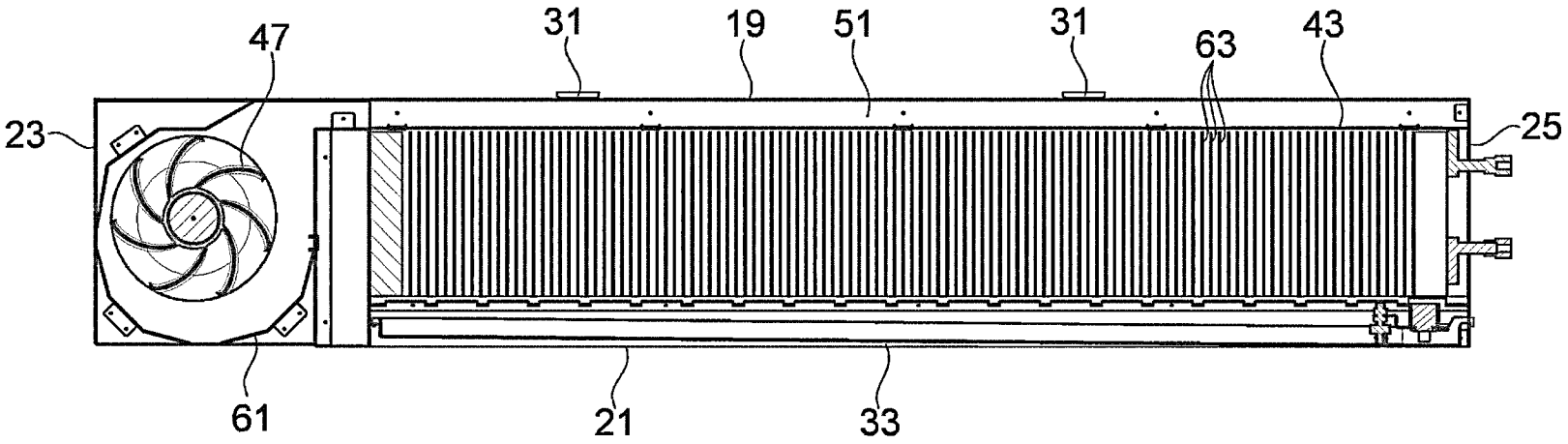
FIG. 11 shows a longitudinal sectional view in plane A-A through the circulating air module.

An inside air inlet opening 33 and an inside air outlet opening 35 are arranged on the lower longitudinal side 21, through which inside air flows into the housing 13 as circulating air 55 and out of said housing as supply air 57. The inside air inlet opening 33 visible in FIG. 11 is elongated and arranged adjacent to the front side 15.

A flow channel 51 is arranged in an upper housing region and runs along the upper longitudinal side 19 and is formed as an elongated, rectangular cavity between the front side 15 and the rear side 17.

Adjacent to one of the transverse sides 23, a region for a fresh air fan 47 and the filter 41 is provided, which extends between the front and rear sides 15, 17. The filter 41 is designed to clean the incoming fresh air 53. The filter 41 (not shown in FIG. 11) is arranged between the fresh air inlet 39 and the fresh air fan 47. The fresh air fan 47 is designed to draw in and distribute fresh air 53. The fresh air fan 47 is a radial fan and is designed to draw fresh air 53 in an axial direction through the fresh air inlet 39 and the filter 41 and to discharge it radially. A fresh air flow deflector 61 in the form of a curved wall runs around the fresh air fan 47 between the front and rear sides, directing the fresh air 53 flowing radially out of the fresh air fan 47 into the flow channel 51. The wall runs around the fresh air fan 47 as a spiral arc that progressively moves away from the fresh air fan 47 and opens into the flow channel 51, so that the fresh air 53 drawn in by the fresh air fan 47 is directed upwards into the flow channel 51.

A heat exchanger 43 is arranged on the front side 15 inside the housing. The heat exchanger 43 runs in the longitudinal direction between the other transverse side 25 and the fresh air fan 47, from which it is separated by a wall, so that the fresh air 53 cannot flow in the longitudinal direction directly from the fresh air fan 47 directly onto the heat exchanger 43. The heat exchanger 43 is arranged between the flow channel 51 and the inside air inlet opening 33. The flow channel 51 is open on its lower side facing the heat exchanger 43, so that air can flow from the flow channel 51 onto the heat exchanger 43. The heat exchanger 43 extends in the depth direction between the front side 15 and the inside air radial fans 49.

The heat exchanger 43 has a flat cuboidal basic shape. It comprises transverse fins 63 that extend between its front and rear sides and run from top to bottom. The spacing of the fins 63 shown in FIG. 11 is not to scale. The fins 63, which run from top to bottom, direct the air flow through the heat exchanger 43 in a vertical direction. A front or rear air outlet would be possible in principle with these fins 63, but is prevented at the front by the front side 15 of the housing 13. Alternatively or additionally, front and rear heat exchanger walls can be provided which prevent air from escaping at the sides and, by means of suitable recesses, only allow air to escape in the depth direction to the inside air radial fans 49.

Due to the positioning of the heat exchanger 43 between the flow channel 51 and the inside air inlet opening 33 and the orientation of its fins 63, inside air flowing in as circulating air 55 hits the heat exchanger 43 from below and is directed vertically upwards. Fresh air 55 hits the heat exchanger 43 from the top of the flow channel 55 and is directed vertically downwards.

Figure 12:
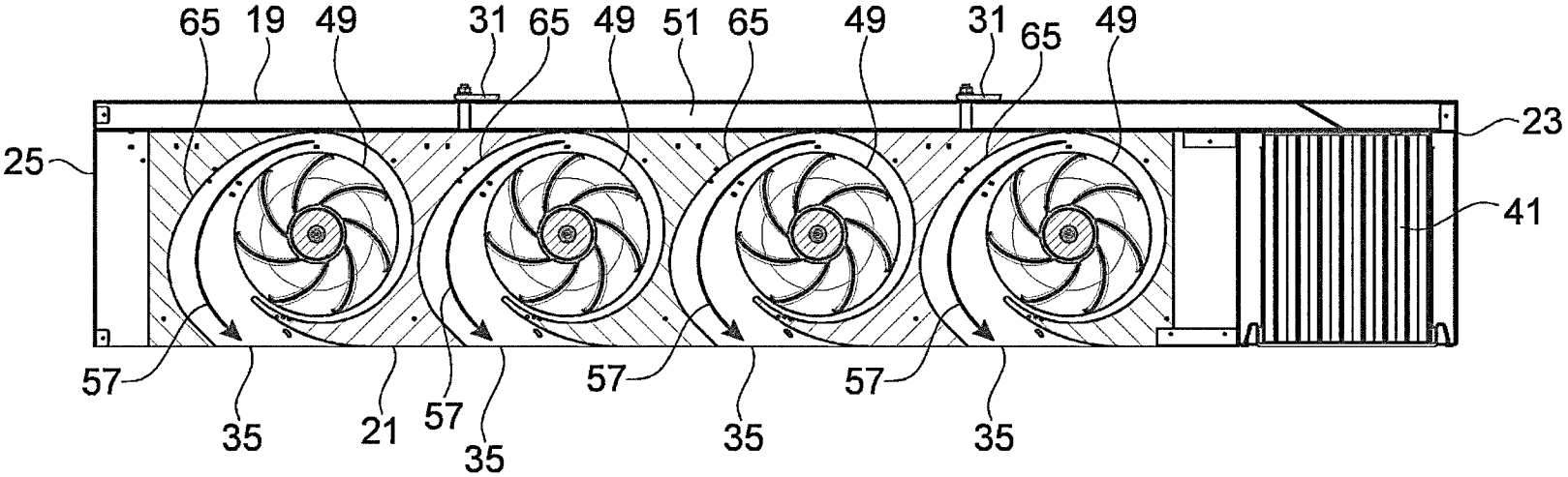

FIG. 12 shows a longitudinal sectional view in plane B-B through the circulating air module 5, with the sectional plane running in a rear region of the circulating air module 5.

Inside the housing there are arranged a number of inside air radial fans 49, each with an axially arranged air inlet. In this exemplary embodiment, four inside air radial fans 49 are provided, which are arranged next to each other along the rear side 17 so that their air inlets face the heat exchanger 43. The inside air radial fans 49 are arranged next to each other between fresh air fan 47 and filter 41, which are arranged one above the other in the depth direction, as well as the transverse side 25 facing away from the fresh air fan 47. The inside air radial fans 49 are arranged next to each other, namely offset in the longitudinal direction, which runs parallel to the longitudinal sides 19, 21.

The axially arranged air inlets of the row of inside air radial fans 49 are arranged in the opposite direction to the air inlet of the fresh air fan 47, which faces the fresh air inlet 39 in the rear side 17. The air inlets of the inside air radial fans 49 face the heat exchanger 43, between which and the rear side 17 the inside air radial fans 49 are arranged. The inside air radial fans 49 are arranged below the flow channel 51. In addition, the inside air radial fans 49 are arranged along a line that runs between the flow channel 51 and the inside air outlet opening 35 in the longitudinal direction. The flow channel 51 is designed in such a way that it is a flow barrier to the inside air radial fans 49, but allows air to pass through to the heat exchanger 43, so that the air cannot flow from the flow channel 51 directly to the inside air radial fans 49, but must flow via the heat exchanger 49 to the inside air radial fans 48.

The region surrounding the inside air radial fans 49 is designed in each case as an inside air flow deflector 65 in the form of a spiral housing, in that a curved wall runs around each inside air radial fan 49 between the rear side 17 and the heat exchanger 43, which deflects the supply air 57 flowing out of the inside air radial fan 49 to the inside air outlet opening 35. The wall runs around the inside air radial fan 49 as a spiral arc that progressively moves away from it and opens into an outlet of the inside air outlet opening 35. In this way, the air flowing out of the inside air radial fan 49 as supply air 57 is directed out of the housing 13 into the interior space. The mixture of fresh air 53 and circulating air 55 leaves the housing 13 as supply air 57 through the inside air outlet opening 35.

The space between the walls of the inside air flow deflectors 65 is advantageously filled (as indicated by the hatching in FIG. 12) or at least covered, so that a barrier is formed for air escaping from the heat exchanger 43 in the depth direction and air can escape from the heat exchanger 43 only or substantially via the inside air radial fans 49 positioned in the inside air flow deflectors 65.

Figure 13:
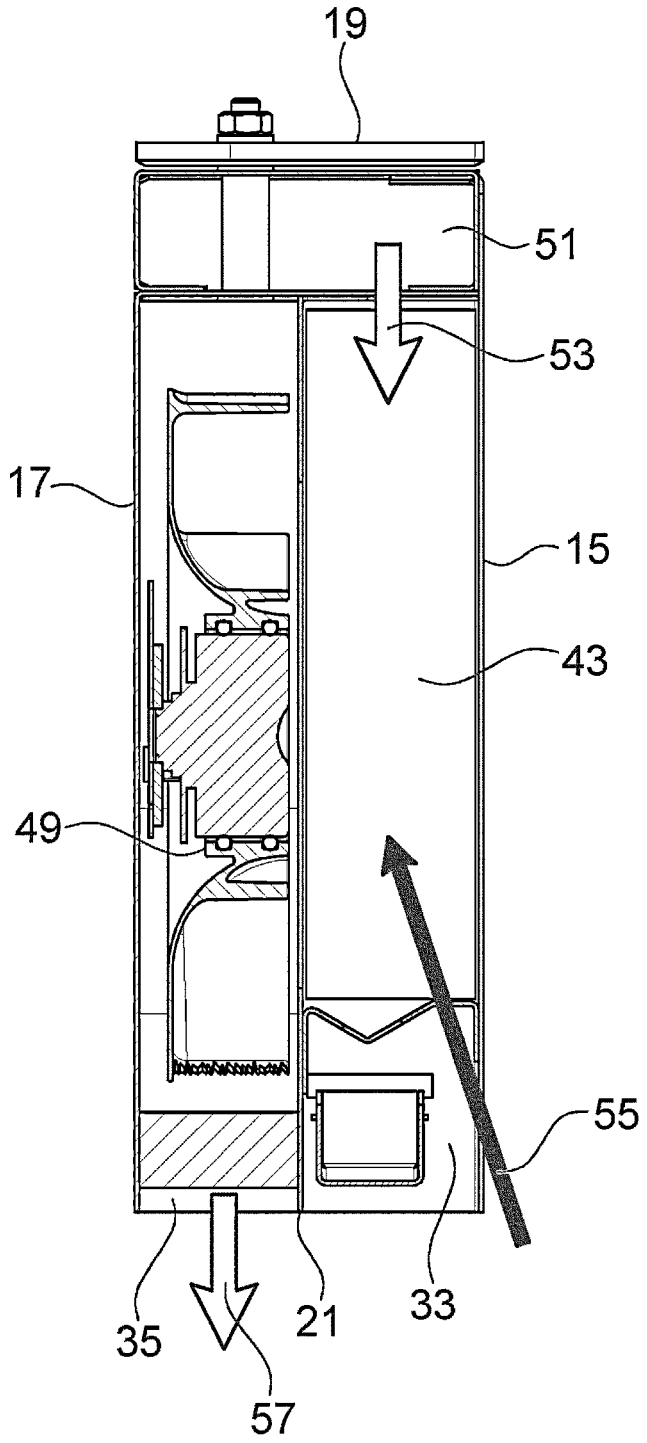

FIG. 13 shows a side sectional view in the plane C-C through the circulating air module 5. The inside air inlet opening 33 is located below the heat exchanger 43 and the inside air outlet opening 35 is located below the inside air radial fan 49. The open regions above the inside air inlet opening 33 and the inside air outlet opening 35 are spatially separated. Above the heat exchanger 43, the flow channel 51 runs between the heat exchanger 43 and the upper longitudinal side 19 of the housing 13 in the longitudinal direction, which guides the fresh air 53 from the fresh air fan 47 to the upper side of the heat exchanger 43. The direct path from the flow channel 51 to the inside air radial fans 49 is blocked so that air can only flow through the heat exchanger 43 to the inside air radial fans 49.

In addition, an electronic control unit 45 for the circulating air module 5 is provided in the housing 13, which is not shown in the sectional views due to its position and compact dimensions.

Figure 14:
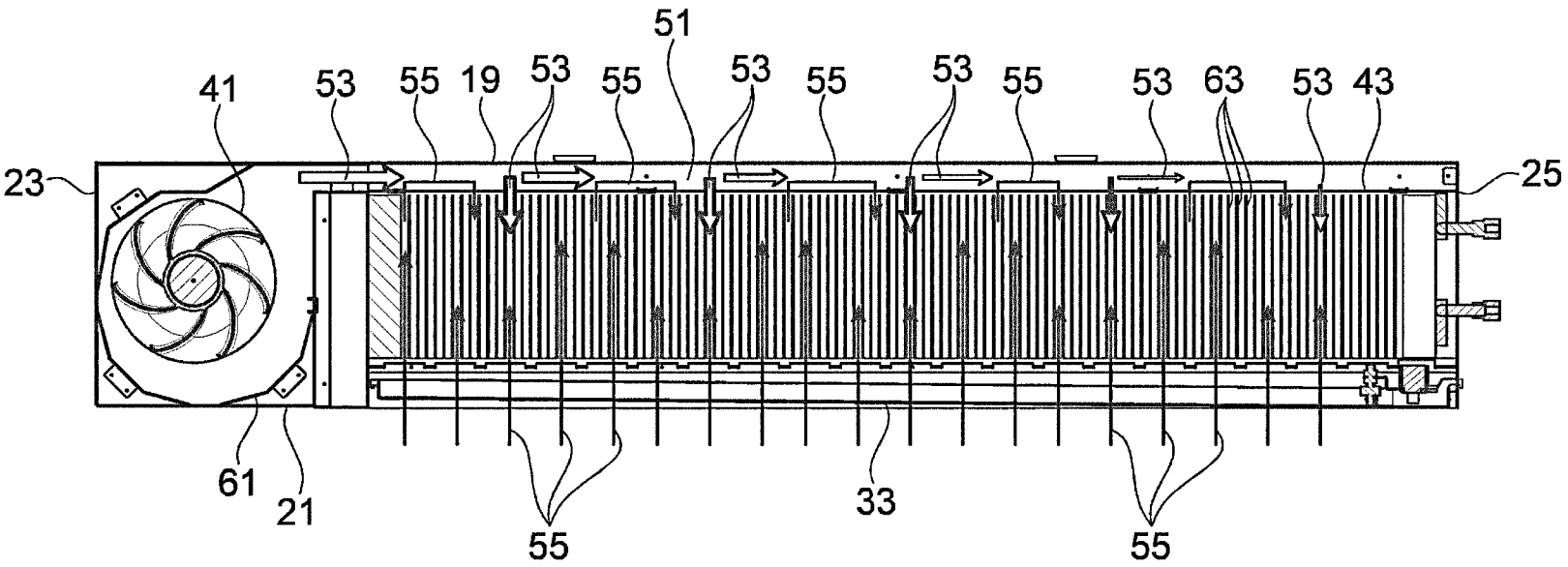

FIG. 14 uses the longitudinal sectional view of the circulating air module 5 from FIG. 11 and arrows to illustrate how the circulating air module 5 works.

Fresh air 53 is drawn in axially through the fresh air inlet 39 through the fresh air fan 47. Before it reaches the fresh air fan 47, the fresh air 53 is cleaned by the filter 41. The fresh air fan 47 discharges the fresh air 53 flowing into the housing 13 radially. The fresh air 53 is directed into the flow channel 51 by the fresh air flow deflector 61. This is supported by the housing 13 being closed below the fresh air fan 47 and a spatial separation acting as a barrier being provided between the fresh air fan 47 and the heat exchanger 43 and the inside air radial fans 49.

The fresh air 53 flows along the flow channel 51 above the heat exchanger 43. As the distance from the fresh air fan 47 increases, more and more fresh air 53 flows out through the heat exchanger 43, so that the fresh air 53 is distributed in the heat exchanger 43. However, the proportion of fresh air 53 flowing out decreases along the path. The fresh air 53 is directed downwards in a vertical direction by the fins 63. The fresh air is drawn in by the inside air radial fans 49 so that the fresh air 53 flows into the heat exchanger 43 mainly in regions vertically above the inside air radial fans 49 and is directed vertically towards the inside air radial fans 49 by the fins 63, which then draw fresh air out of the heat exchanger 43 in the depth direction. The depth direction runs transversely to the longitudinal direction between the front side 15 and rear side 17.

The inside air flows as circulating air 55 through the inside air inlet opening 33 into the heat exchanger 43 of the circulating air module. It is directed upwards in a vertical direction by the fins 63. Inside air flowing in a vertical direction as circulating air 55, which is directed onto the inside air radial fans 49, is discharged from the heat exchanger 43 by these. Inside air flowing in a vertical direction as circulating air 55, which is deflected by the fins 63 past the inside air radial fans 49, in particular between them, flows into the flow channel 51. The circulating air 55 is deflected by the flow channel 51 and drawn in by the inside air radial fans 49, so that the circulating air 55 flows back into the heat exchanger 43 mainly vertically above the inside air radial fans 49 and is then discharged by the inside air radial fans 49.

The above-mentioned flows are illustrated by arrows in FIG. 14. Arrows for the air flows are also shown in FIG. 13. The supply air 55 and the fresh air 53 mix during and after the flow through the inside air radial fans 49, when the supply air 55 flows from below through the heat exchanger 43 and the fresh air 55 flows from above through the heat exchanger 43 and meet one another in the region of the air inlets of the inside air radial fans 49, are drawn into the inside air radial fans 49 in the depth direction and discharged through them. In addition, the circulating air 55 and the fresh air 53 mix to some extent upstream of the inside air radial fans 49 in the heat exchanger 43, especially if the circulating air 55 and fresh air 53 have the same path, namely if the circulating air 55 deflected downwards in the flow channel 51 already meets the fresh air 53 flowing downwards there. The mixture of fresh air 53 and circulating air 55 leaves the housing 13 as supply air 57 through the inside air outlet opening 35.

The climate of the space is improved by circulating and controlling the temperature of the inside air with the simultaneous addition of fresh air 53. The proportion of mixed fresh air 53 is low compared to the recirculated inside air, as a large proportion of the inside air has to pass through the heat exchanger 43 for cooling and heating. The proportion of inside air that has to be renewed due to building occupants and visitors breathing in and out, on the other hand, is low and hardly affects the temperature control process. A typical maximum value for added fresh air is 20%.

The exemplary embodiments described above can be modified in that no internal fresh air fan 47 is provided. Fresh air is then supplied through openings in the housing and can be supported by an external fresh air fan or a fresh air duct supplying fresh air.

Figure 15:
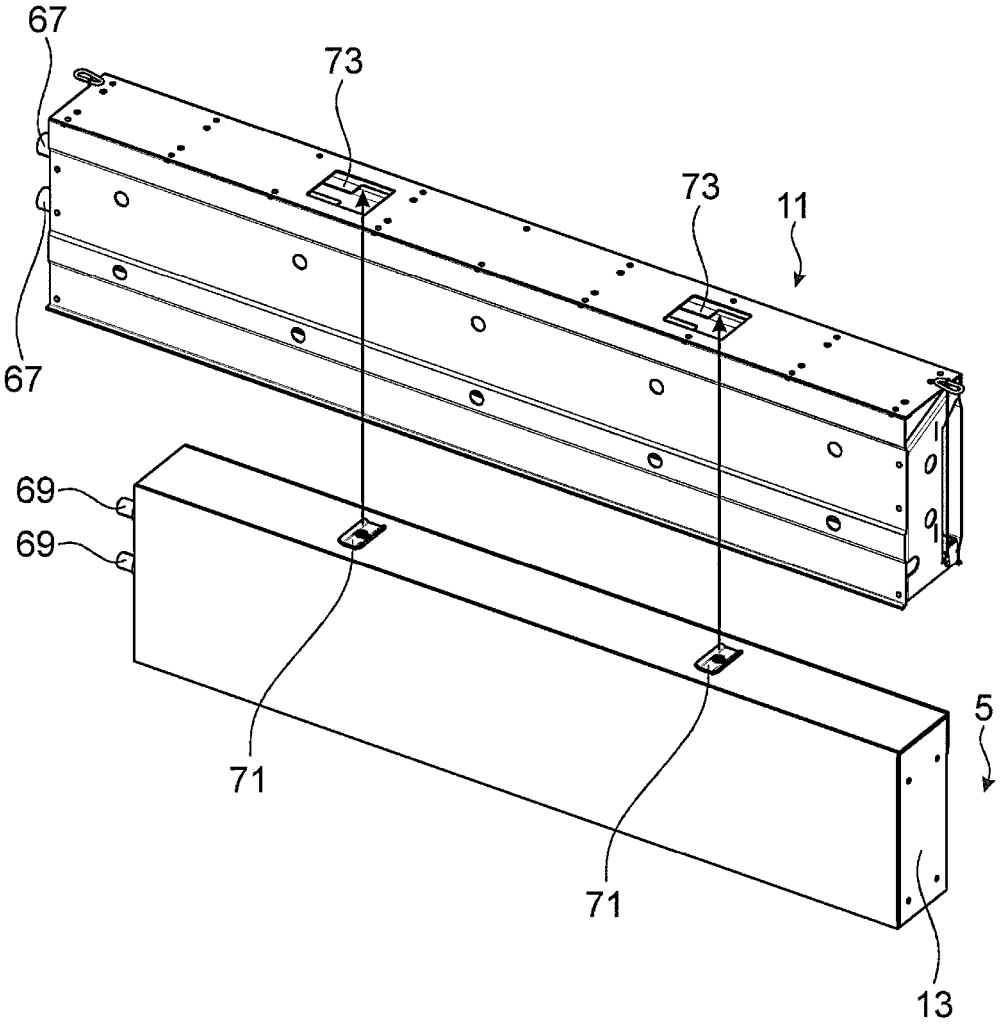

FIG. 15 shows a further exemplary embodiment of a circulating air module system with a mounting frame 11 and a circulating air module 5 in a three-dimensional representation.

The mounting frame 11 can be designed as a drywall frame, for example, and can be integrated into a building wall to provide space for the circulating air module 5 to be installed later. Alternatively, the mounting frame 11 can be ceiling-mounted. The mounting frame 11 has a cuboidal basic shape with an open underside so that the circulating air module 5 can be inserted into the mounting frame from below.

Fluid connections 67, which can be connected to heat exchanger connections 69 of the circulating air module 5, are located on one end face of the mounting frame. The fluid connections 67 are connected to lines for the inflow and outflow of a working medium, which can emit cold or heat depending on the operating mode. The fluid connections 67 are advantageously provided with a valve to prevent the working medium from escaping if no circulating air module 5 is used. Advantageously, electrical supply, communication and control connections are also provided in the mounting frame 11, which can be connected to cables routed to the mounting frame and through which the supply, communication and control of the circulating air module 5 takes place. On the upper side of the mounting frame 11 there are fastening means 73, which can be detachably connected to fastening means 71 of the circulating air module 5.

The circulating air module 5 has a cuboidal housing 13 in which a heat exchanger 43, inside air radial fans 49 and a fresh air fan 47 (not shown in FIG. 15) are arranged. There are fastening means 71 on the upper side of the housing 13, which can form a detachable connection with the fastening means 73 of the mounting frame 11.

The circulating air module 5 is mounted by pushing it into the mounting frame 11 from below and then moving it sideways in the direction of the fluid connections 67, thereby locking it in place. As a result of the sideways movement, the fastening means 71 of the circulating air module 5 engage with the corresponding fastening means 73 of the mounting frame 11, so that an interlocking connection is formed by the mutually engaging fastening means 71, 73, which prevents the circulating air module 5 from falling out. During the sideways movement, the heat exchanger connections 69 and the fluid connections 67 form a connection so that the working medium can flow through the heat exchanger 43. In one exemplary embodiment, the connections between heat exchanger connections 69 and fluid connections 67 are quick couplings. Corresponding electrical connection means form electrical connections so that supply, communication and control of the circulating air module 5 are made possible. Alternatively or additionally, communication and control can be radio-based.

Figure 16:
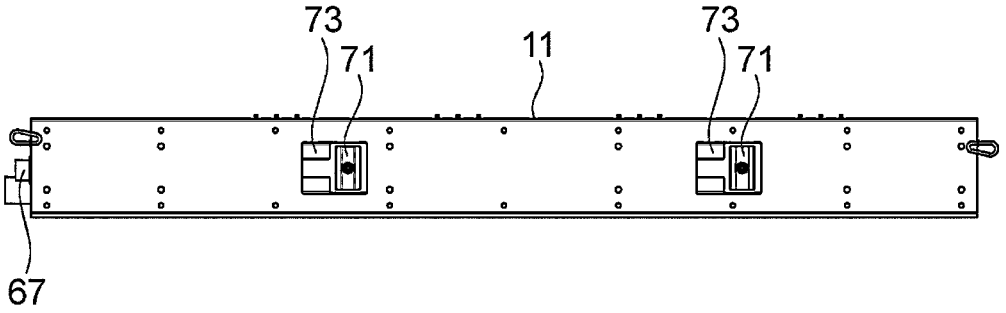
Figure 17:
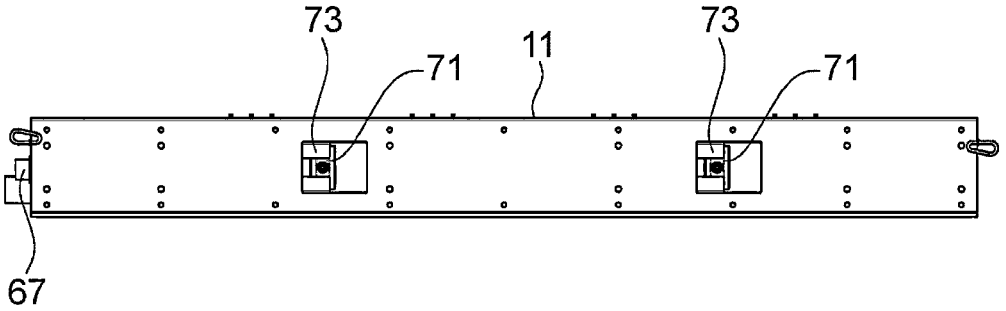

FIGS. 16 and 17 illustrate the assembly using a top view of the mounting frame 11, into which the circulating air module 5 has already been inserted from below. The fastening means 71, 73 are aligned with each other so that the latch-shaped fastening means 71 of the circulating air module 5 engages in a recess of the fastening means 73 on the mounting frame 11. The heat exchanger connections 69 and the fluid connections 67 are aligned with each other.

FIG. 17 shows the locked state after the sideways movement, so that the fastening means 71, 73 engage with each other, in that the latch-shaped fastening means 71 has been pushed onto supports of the fastening means 73 in the mounting frame 11. The circulating air module 5 can no longer fall out of the mounting frame 11. The fluid connections 67 and the heat exchanger connections 69 are connected. An electrical connection was also established.

Figure 18:
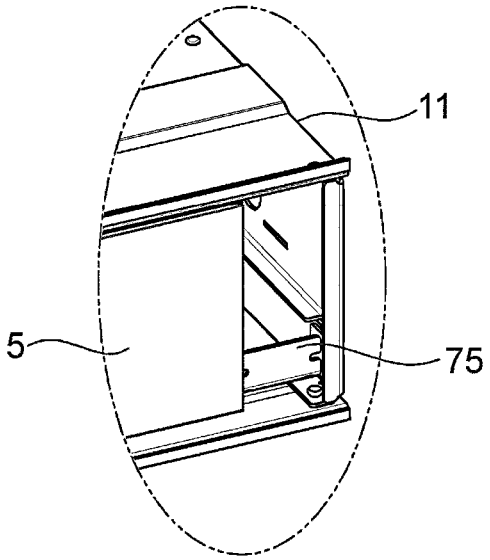

FIG. 18 shows a three-dimensional detailed view of the underside in the front region. A safety device is provided on the underside, in which a tongue-shaped rotatable safety plate 75 has been moved under the circulating air module 5 in order to prevent the circulating air module 5 from falling out unintentionally, in particular when the circulating air module 5 is removed. By turning the safety plate 75, the underside opening in the mounting frame 11 is released and the circulating air module 5 can be moved in or out of the mounting frame 11.

The above-described connections between the mounting frame 11 and the circulating air module 5 can be detached. To remove the circulating air module 5 from the mounting frame 11, the connections between the heat exchanger connections 69 and the fluid connections 67 are loosened using a tool that reaches into the mounting frame 11 from below. The safety plate 75 on the underside is turned away and the circulating air module 5 can be removed downwards from the mounting frame 11 after a sideways movement, during which the fastening means 71, 73 as well as the heat exchanger connections 69 and fluid connections 67 are released from each other.

Figure 19:
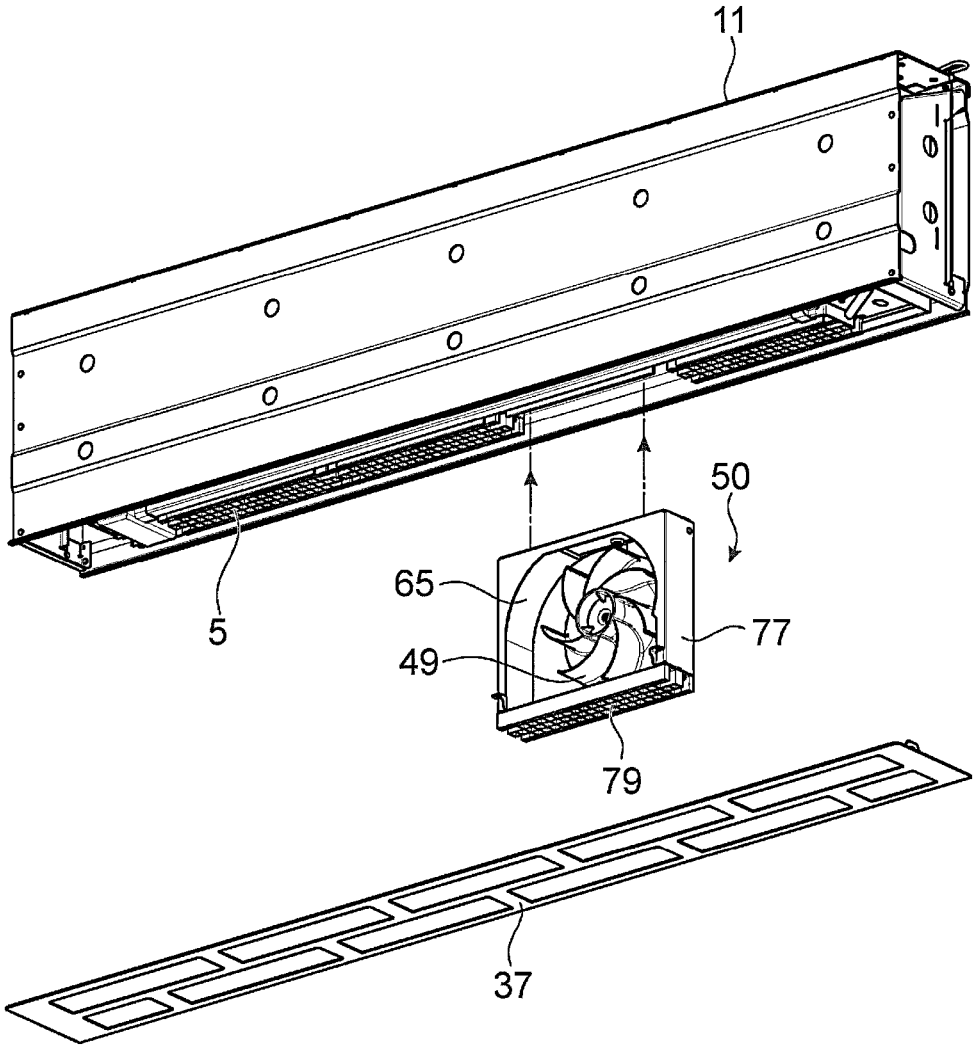

FIG. 19 shows a three-dimensional representation of the mounting frame 11 in which the circulating air module 5 is arranged. There is a removable grille 37 on the underside of the mounting frame 11, which directs the air flows and makes access to the fans more difficult in order to prevent injury and damage.

The circulating air module 5 in this exemplary embodiment does not have a fresh air fan 47. The fresh air 53 is supplied through a fresh air inlet 39 with several openings in the housing 13. In this exemplary embodiment, four inside air radial fans 49 are provided as an example, which are of modular design so that they can each be removed from the housing 13 as part of a fan module 50 and replaced if necessary without having to remove and open the entire circulating air module 5 from the mounting frame 11. The fan module 50 comprises a module housing 77 surrounding the inside air radial fan 49 with a inside air flow deflector 65 and a module grille 79 on the underside through which the air flows.

Figure 20:
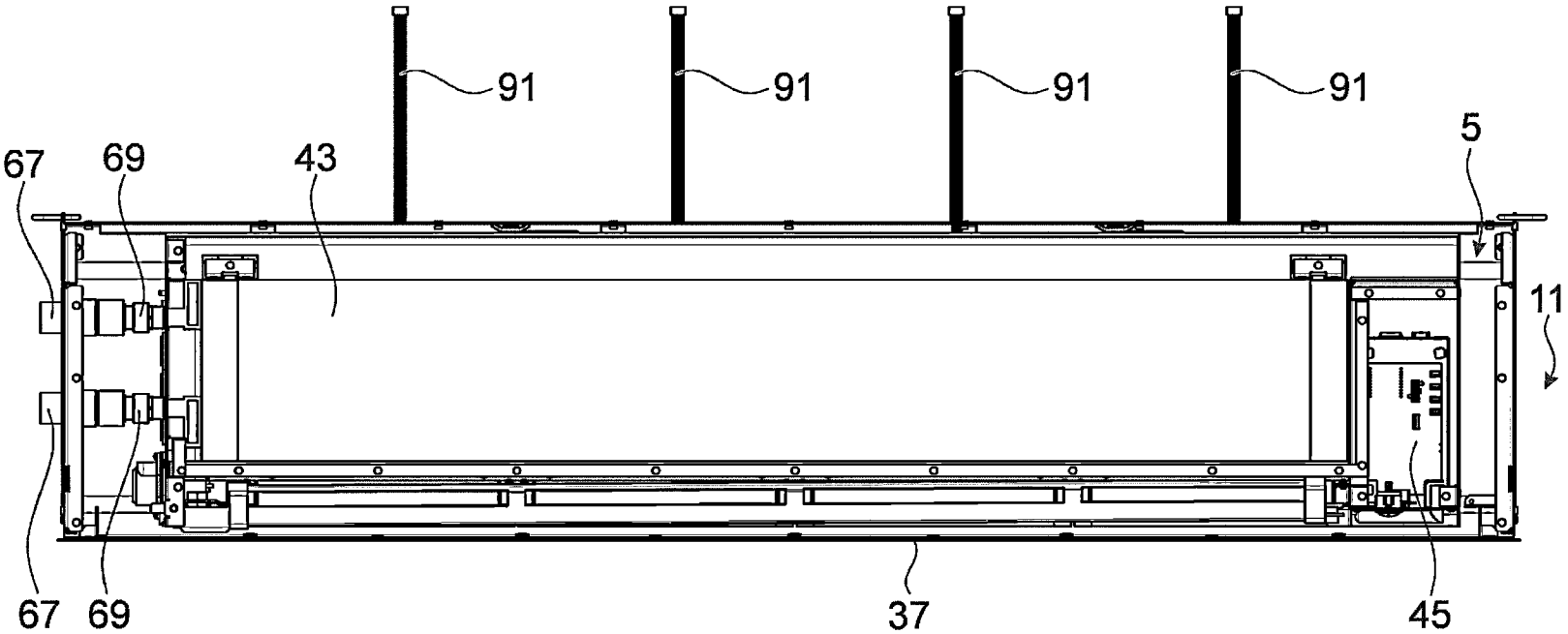

FIG. 20 shows the interior of the circulating air module system with the circulating air module 5 arranged in the mounting frame 11. The front of the housing 13 is not shown, so that the heat exchanger 43 is visible. It has heat exchanger connections 69, which are connected to the fluid connections 67 of the mounting frame 11. An electrical control unit 45 is arranged on the side of the heat exchanger 43.

Figure 21:
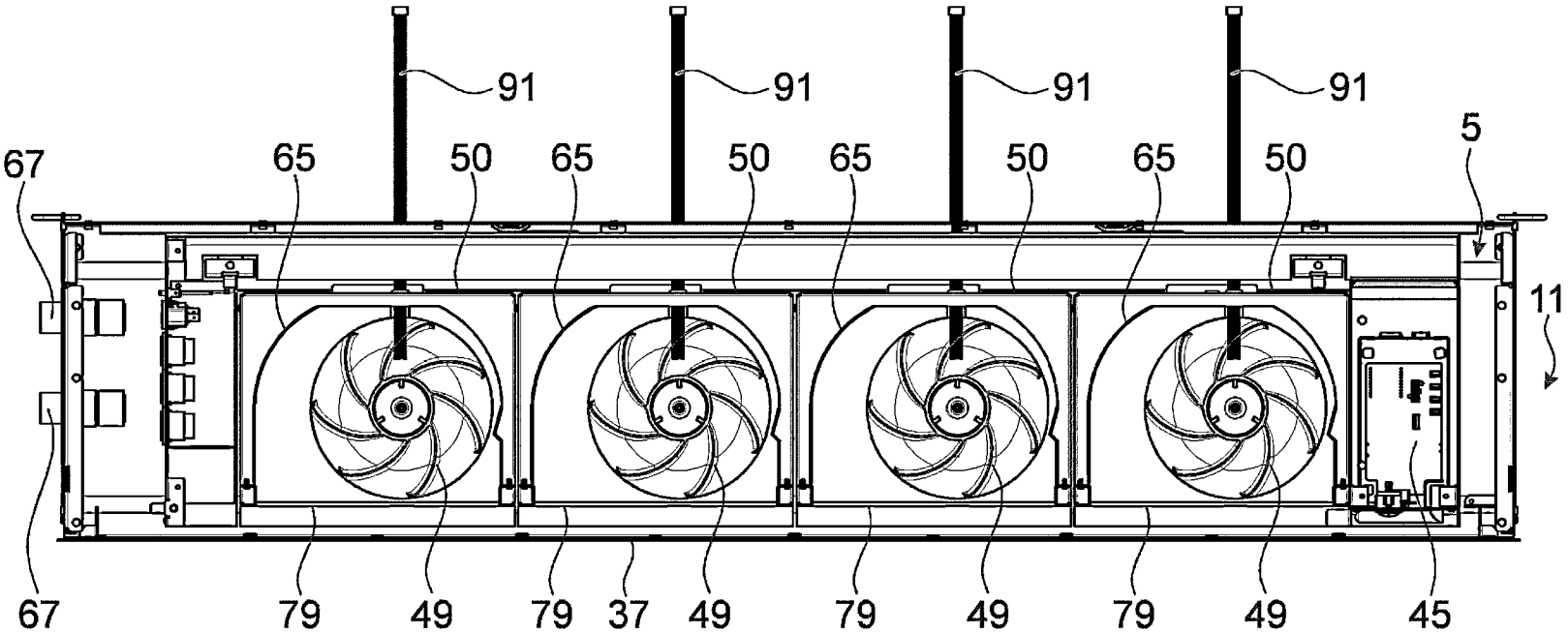

FIG. 21 shows the interior of the circulating air module system. In this view, the heat exchanger 43 has also been removed so that the fan modules 50, each with a inside air radial fan 49, are visible. Supply lines 91 for the inside air radial fans 49 protrude from the housing 13 and through the mounting frame 11. Each of the fan modules 50 can be removed individually. The fan module 50 comprises a module housing 77 surrounding the inside air radial fan 49 and a module grille 79 on the underside through which the air flows out. A radially curved inner wall runs around the inside air radial fan 49 and forms an inside air flow deflector 65, which directs the air from the inside air radial fan 49 out of the fan module 50 through the module grille 79.

A plane runs through the inside air radial fans 49 so that their axially arranged air inlets point away from the same side of the plane and towards the heat exchanger 43. The inside air radial fans each have an axis of rotation around which a fan wheel rotates. The axes of rotation and thus the air inlets run perpendicular to the plane and parallel to each other.

Figure 22:
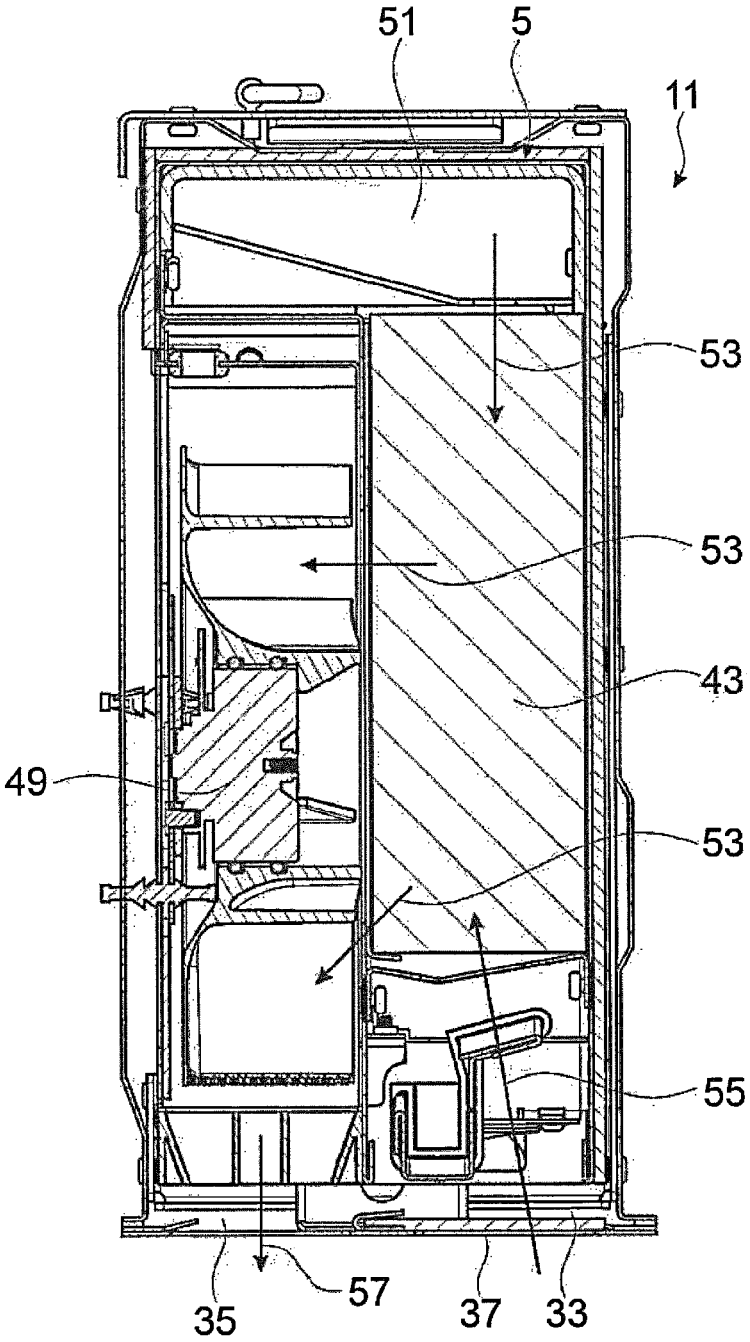

FIG. 22 shows a side section through the modular system, which runs through one of the inside air radial fans 49. The inside air inlet opening 33 is located below the heat exchanger 43 and the inside air outlet opening 35 is located below the inside air radial fan 49. The open regions above the inside air inlet opening 33 and the inside air outlet opening 35 are spatially separated. Above the heat exchanger 43, a flow channel 51 runs between the heat exchanger 43 and the upper longitudinal side 19 of the housing 13 in the longitudinal direction, which guides the fresh air 53 from the openings of the fresh air inlet 39 to the upper side of the heat exchanger 43. The openings are located in the side wall of the fresh air duct 51. The direct path from the flow channel 51 to the inside air radial fans 49 is blocked and only possible through the heat exchanger 43.

Figure 23:
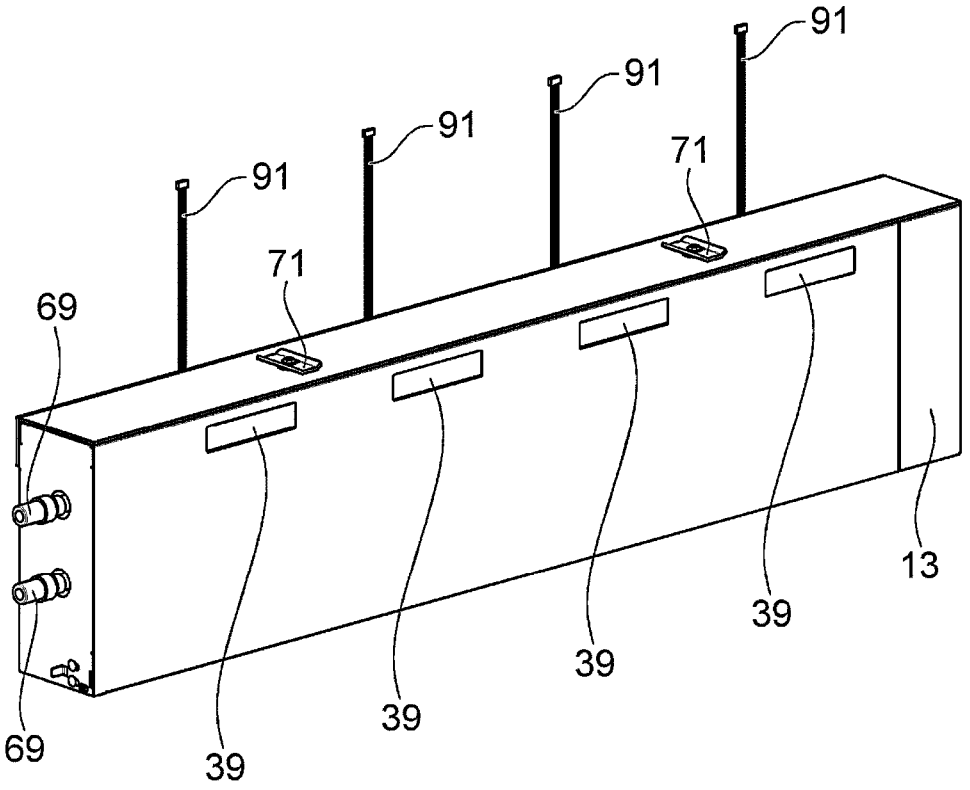

FIG. 23 shows an exemplary embodiment of a circulating air module 5 in a three-dimensional view from above, which is particularly suitable for use in the ceiling region 83. It has several openings of the fresh air inlet 39 in the upper side region of the housing 13, through which the fresh air 53 can easily be guided into the flow channel 51 and via the flow channel 51 to the heat exchanger 43. In addition, the fresh air duct 85 can be easily connected to the side of a mounting frame 11 with corresponding fresh air inlets.

Alternatively, the openings of the fresh air inlet 39 can also be provided on the side of the heat exchanger 43 so that fresh air 53 flows into it from the side.

Figure 24:
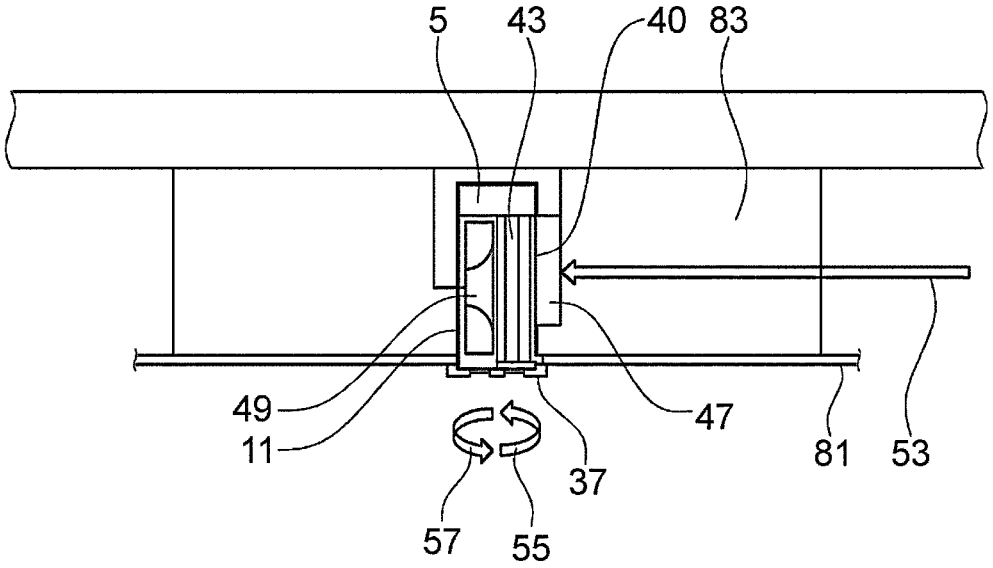

FIG. 24 illustrates an installation of an exemplary embodiment of a circulating air module system with a circulating air module 5 and a mounting frame 11 in a suspended ceiling 81.

The ceiling 81 has slots for the air inlet and outlet of the circulating air module 5, which is arranged so that its underside faces the slot. In a ceiling region 83, which is limited downwards by the suspended ceiling 81, a mounting frame 11 is provided for the circulating air module 5, the open underside of which is aligned with the slot. The circulating air module 5 can be inserted into the mounting frame 11 through the slot in the ceiling 81, for example as described in conjunction with the previous exemplary embodiments. The mounting frame 11 protrudes from the suspended ceiling 81 into the ceiling region 83 and can be attached to the ceiling of the building. A grille 37 is attached to the mounting frame 11 in front of the slot on the underside of the ceiling 8.

There is a fresh air inlet 40 in the mounting frame 11, the position of which corresponds to the fresh air inlet 39 of the circulating air module 50. Fresh air is supplied via the ceiling region 83, into which fresh air 53 can flow from outside. This can be supported by a separate fan in the ceiling region 83 or in the building wall.

In this exemplary embodiment, a fresh air fan 47 is arranged on the outside of the mounting frame 11, which draws fresh air 53 from the ceiling region 83 and blows it into the circulating air module 5.

The fresh air 51 is mixed with the circulating air 55 in the heat exchanger 43, as already described in detail in conjunction with FIG. 14 and the exemplary embodiments with an internal fresh air fan 47.

In one exemplary embodiment, the fresh air access 40 can advantageously be coupled with a fresh air duct 85 in the ceiling region 83 supplying fresh air 53, through which fresh air 53 is fed to the circulating air module 5. Circulating air 55 from the space and supply air into the space 57 are illustrated by arrows.

Figure 25:
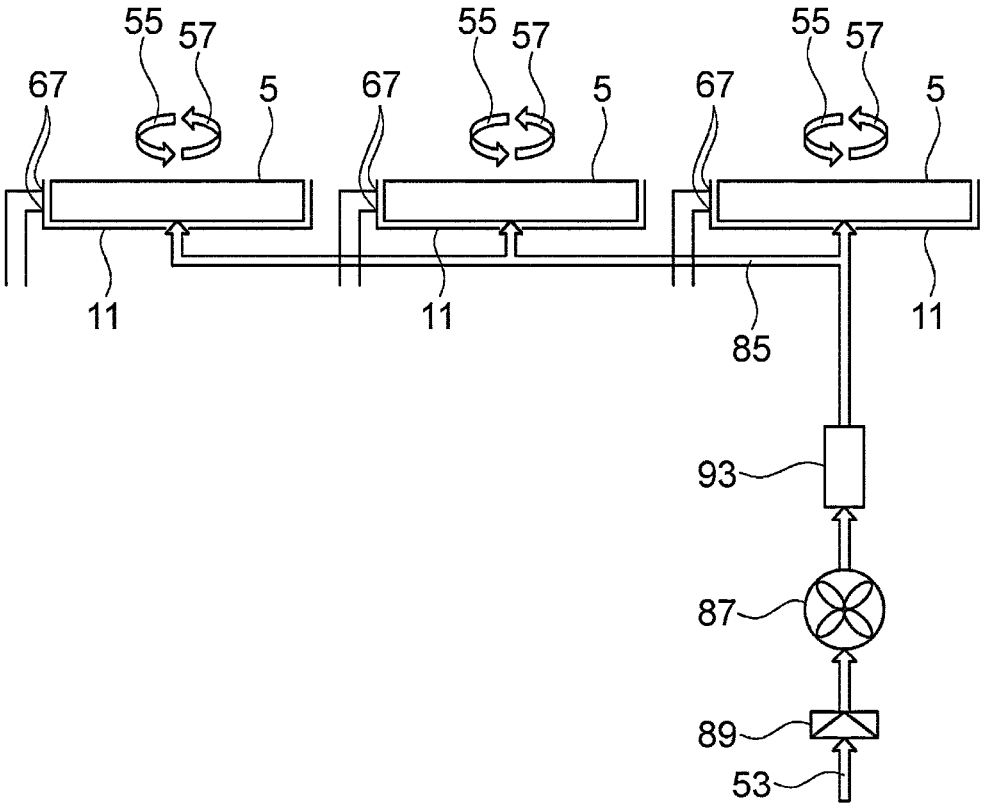

FIG. 25 schematically illustrates a ventilation system with several circulating air modules 5 in the ceiling, which are supplied with fresh air 53 via a fresh air duct 85 in the ceiling region 83. The fresh air duct 85 can be tubular or formed as a flat duct with a rectangular cross-section. Branches lead to the circulating air modules 5 of the ventilation system. The fresh air 53 is drawn in from outside through a filter via a fan and fed through the fresh air 85 to the circulating air modules 5 through their mounting frame 11. A downstream silencer 93 reduces the noise level.

Exemplary embodiments of circulating air modules 5 without fresh air fan 47 in the housing 13 are preferably used as ceiling-mounted circulating air modules 5. The fresh air can be supplied through a fresh air duct 85.

The features indicated above and in the claims, as well as the features which can be seen in the figures, can advantageously be implemented both individually and in various combinations. The invention is not limited to the described exemplary embodiments, but can be modified in many ways within the scope of the capabilities of a person skilled in the art.

LIST OF REFERENCE SIGNS

1 Building wall
3 Windows
5 Circulating air module
7 Roller shutter box
9 Wall cladding
11 Mounting frame
13 Housing
15 Front side
17 Rear side
19 Upper longitudinal side
21 Lower longitudinal side
23, 25 Transverse side
27 Tongue
29 Strut
31 Latch
33 Inside air inlet opening
35 Inside air outlet opening
37 Grille
39 Fresh air inlet
40 Fresh air access
41 Filter
43 Heat exchanger
45 Control unit
47 Fresh air fan
49 Inside air radial fan
50 Fan module
51 Flow channel
53 Fresh air
55 Circulating air
57 Supply air
59 Profile
61 Fresh air flow deflector
63 Fins
65 Inside air flow deflector
67 Fluid connection
69 Heat exchanger connection
71, 73 Fastening means
75 Safety plate
77 Module housing
79 Module grille
81 Suspended ceiling
83 Ceiling region
85 Fresh air duct
87 Fan
89 Filter
91 Supply line
93 Silencer

The invention claimed is:

1. A circulating air module (5) with fresh air intake, which can be introduced into a building wall (1) of an interior space or secured to the building wall (1) of the interior space, or which can be introduced into a ceiling region (83) or secured to a ceiling (83) of an interior space, comprising a housing (13) with a front side (15) and an opposing rear side (17), and with a fresh air inlet (39) which is designed such that fresh air (53) can flow into the housing (13), and with an inside air inlet opening (33) and an inside air outlet opening (35), a heat exchanger (43) arranged in the housing (13), an inside air radial fan (49) arranged in the housing (13) and having an axially arranged air inlet, facing the heat exchanger (43), such that inside air flowing in through the inside air inlet opening (33) as circulating air (55) can be drawn through the heat exchanger (43), wherein the heat exchanger (33) is arranged between one of the front and rear side (15, 17) and the inside air radial fan (21), the air inlet of which is facing said side (15, 17), and wherein the circulating air module (5) is designed such that the fresh air (53) is supplied to the circulating air (55) in the housing (13) and the circulating air (55) flows out of the inside air outlet opening (35) as supply air (57) along with the added fresh air (53).

2. The circulating air module (5) according to claim 1, which is designed so that the fresh air (53) can be drawn through the heat exchanger (43) and mixes with the circulating air (55) in the heat exchanger (43) and/or in the inside air radial fan (49).

3. The circulating air module (5) according to claim 1, wherein the inside air radial fan (49) is one of a plurality of inside air radial fans (49) that are arranged laterally next to one another between the front side (15) and the rear side (17) of the housing (13), in particular are offset relative to one another in a longitudinal direction, so that the axially arranged air inlets of the inside air radial fans (49) face the heat exchanger (43).

4. The circulating air module (5) according to claim 3, wherein a plane runs through the inside air radial fans (49) so that their axially arranged air inlets point away from the same side of the plane.

5. The circulating air module (5) according to claim 4, wherein the inside air radial fans (49) each have an axis of rotation, and wherein the axes of rotation extend perpendicularly or substantially perpendicularly to the plane and/or the axes of rotation extend parallel or substantially parallel to one another.

6. The circulating air module (5) according to claim 1, wherein the inside air inlet opening (15) and the inside air outlet opening (17) are arranged on a longitudinal side (19, 21) of the housing (13).

7. The circulating air module (5) according to claim 6, wherein the fresh air inlet (39) comprises one or more openings in the housing (13), which are arranged at the front side or rear side adjacent to the longitudinal side opposite the inside air inlet opening (15) and the inside air outlet opening (17).

8. The circulating air module (5) according to claim 7, wherein the inside air inlet opening (33) is arranged adjacent to the front side (15), to which the heat exchanger (43) is adjacent, and wherein the inside air outlet opening (35) is arranged adjacent to the rear side (17), to which the inside air radial fan or fans (49) are adjacent, and wherein the fresh air inlet (39) is arranged at the front side.

9. The circulating air module (5) according to claim 1, comprising a flow channel (51) which is designed to guide the fresh air (53) to the heat exchanger (43).

10. The circulating air module (5) according to claim 9, wherein the flow channel (51) extends between the heat exchanger (43), through which the fresh air (53) can be drawn in with the inside air radial fan or fans (49), and a longitudinal side (19, 21) of the housing (13) and the fresh air inlet (39) opens into the flow channel (51).

11. The circulating air module (5) according to claim 1, comprising a fresh air fan (47) arranged in the housing (13) and supplying the fresh air (53), which is arranged between the front (15) and the rear (17) of the housing (13) laterally next to the inside air radial fan or fans (49), or comprising a fresh air fan (47) arranged outside the housing (13) and supplying fresh air (53) through the fresh air inlet (39).

12. The circulating air module (5) according to claim 1, wherein an inside air flow deflector (65) runs around the inside air radial fan or fans (49) and is designed to direct air flowing out of the inside air radial fan (49) to the inside air outlet opening (35).

13. The circulating air module (5) according to claim 1, wherein the inside air radial fan or fans (49) are of modular design.

14. A circulating air module system with the circulating air module (5) according to claim 1 and a mounting frame (11) which can be installed in a ceiling region (83) or can be fastened to a ceiling, in particular can be mounted on a suspended ceiling (81), so that the inside air inlet opening (15) and the inside air outlet opening (17) of the circulating air module (5) face the interior of the space.

15. The circulating air module system according to claim 14, wherein the mounting frame (11) or the fresh air inlet (39) can be coupled to a fresh air duct, via which fresh air (53) can be guided to the circulating air module (5).

* * * * *